US008552875B2

(12) United States Patent
Burdenko

(10) Patent No.: US 8,552,875 B2
(45) Date of Patent: Oct. 8, 2013

(54) EFFICIENT AND SAFE DOOR LOCKING CONTROL IN POWER-OFF AND POWER-ON CONDITIONS

(75) Inventor: Michael N. Burdenko, Wellesley Hills, MA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 480 days.

(21) Appl. No.: 12/789,989

(22) Filed: May 28, 2010

(65) Prior Publication Data

US 2011/0291846 A1 Dec. 1, 2011

(51) Int. Cl.
*G08B 21/00* (2006.01)

(52) U.S. Cl.
USPC ..... 340/635; 340/540; 340/541; 340/547; 340/5.26; 340/5.53; 340/5.64; 340/5.73; 49/28; 49/373

(58) Field of Classification Search
USPC ..... 340/635, 540, 545.1, 547, 5.26, 5.53, 340/5.64, 5.73; 49/28, 373
See application file for complete search history.

(56) References Cited

U.S. PATENT DOCUMENTS

| | | | | |
|---|---|---|---|---|
| 5,515,649 | A | 5/1996 | Strab | |
| 5,605,364 | A | 2/1997 | Shelledy | |
| 5,933,067 | A | 8/1999 | Frolov | |
| 6,611,414 | B1 | 8/2003 | Lavelle et al. | |
| 7,205,872 | B2 | 4/2007 | Baechle et al. | |
| 7,856,760 | B2 | 12/2010 | Klingbyle | |
| 2002/0196123 | A1* | 12/2002 | Diehl et al. | 340/5.64 |
| 2003/0167693 | A1* | 9/2003 | Mainini | 49/28 |
| 2003/0178857 | A1* | 9/2003 | Caspi et al. | 292/144 |
| 2004/0245855 | A1 | 12/2004 | Bachle | |
| 2005/0108945 | A1 | 5/2005 | Wiemer et al. | |
| 2007/0096856 | A1 | 5/2007 | Wiemer et al. | |
| 2009/0288346 | A1* | 11/2009 | Esser | 49/373 |

OTHER PUBLICATIONS

Leaflet entitled "Sensor Technology PSEN" for PILZ, Apr. 2009, 74 pages.
News flyer entitled "PSENslock Safety Gate Systems—Now With 1000 N of Magnetic Force" for PILZ, Apr. 2009, 2 pages.
"Machine Guarding Safety Products," for Schmersal, GK-C Condensed Catalog, 12 pages.
Operating Instructions for "PSENslock Safety Gate System," for PILZ, 21909-04, PSEN sl-1.0p-1.1/2.1/2.2/1.1 VA, May 2010, 15 pages.
Office Action dated Feb. 1, 2013 for U.S. Appl. No. 12/822,742, 22 pages.

* cited by examiner

*Primary Examiner* — Tai T Nguyen
(74) *Attorney, Agent, or Firm* — Turocy & Watson, LLP; William R. Walbrun; John M. Miller

(57) ABSTRACT

Systems, methods, and devices that efficiently control the operating state of an electromagnetic lock under power on and power off conditions are presented. A lock component includes a solenoid component (e.g., bi-stable latching solenoid) that holds a lock pin in a locked or unlocked position without using power to hold the lock pin in the desired position, and using power to transition from one position to another position. A sensor component senses when power to the lock component will be lost, and if the lock pin is not in the desired position for the power off condition, the lock pin can be transitioned to the desired position, and if the lock pin is in the desired position for power off condition, the lock component can maintain the lock pin in the desired position, while the lock component is in the power off condition.

18 Claims, 12 Drawing Sheets

EFFICIENT AND SAFE DOOR LOCKING CONTROL IN POWER-OFF AND POWER-ON CONDITIONS

TECHNICAL FIELD

The subject specification relates generally to operation of electromagnetic door locks, and in particular to efficient and safe operational control of electromagnetic door locks under power-off and power-on conditions.

BACKGROUND

Certain areas (e.g., rooms, secured production areas, etc.) can be accessed via a door (e.g., swinging door, sliding door, etc.), wherein, as desired, a particular defined area can be secured by having a lock on the door to the defined area. Typically, an electromagnetic lock can be used to lock a door to a defined area, where the defined area can be used, for example, for storage of product, for production line operations, etc. Certain electromagnetic locks employ magnetic locks or linear solenoids, which require power in order to maintain the lock in the locked position with respect to the door with which the lock is associated. Conventional electromagnetic locks typically lose their adhesive forces under power off conditions (e.g., when power to the lock is lost or otherwise discontinued). That is, the solenoid in a conventional electromagnetic lock typically loses its holding force to hold the lock in the locked position when there is a loss of power to the solenoid. Further, under power on conditions, conventional electromagnet and solenoid based locks can consume significant power and generate heat.

It is desirable to be able to maintain a door lock in a desired state (e.g., locked position) during power off conditions, such as power failure situations, as the defined area associated with the door can be secured and/or energy can be conserved and/or loss of product stored in the defined area can be minimized or eliminated. It is also desirable to conserve power associated with operating the door lock and maintaining the door lock in a locked position during power on conditions. It is further desirable to be able to use the door lock on a variety of different types of doors.

SUMMARY

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form as a prelude to the more detailed description that is disclosed later.

Systems, methods, and devices that efficiently control the operating state (e.g., locked position, unlocked position) of a door lock (e.g., an electromagnetic door lock) under power on and power off conditions are presented. The lock component can be employed to secure a defined physical area (e.g., room, secured production area, etc.), for example, by using the lock component on a door frame at an entrance way to the defined physical area, and engaging a lock pin to be inserted in a lock receptacle (e.g., lock plate) associated with the door in order to lock the door. In an aspect, the lock component (e.g., electromagnetic lock) can include a solenoid component (e.g., bi-stable latching solenoid) that can include or otherwise be associated with a solenoid plunger and the lock pin, wherein the solenoid plunger can be desirably attached to the lock pin via a coupling. The solenoid component can hold the solenoid plunger, and thereby hold the lock pin in a locked or unlocked position, for example, in relation to a lock receptacle associated with the door, without using power to hold the lock pin in the desired position. In an aspect, the solenoid component can comprise at least a first holder component and a second holder component, wherein the first holder component can apply a desired amount of force (e.g., magnetic force) on the solenoid plunger, and thereby on the lock pin, wherein the solenoid plunger can have at least a portion that is formed of a ferromagnetic material that can be attracted to magnetic and electromagnetic forces, to hold the solenoid plunger to thereby hold the lock pin in a first position (e.g., unlocked position) without using power and the second holder component can apply a desired amount of force (e.g., magnetic force) to hold the solenoid plunger and thereby to hold the lock pin in a second position (e.g., locked position), at respective desired times, and in accordance with predefined operation criteria. When it is desired to transition the lock pin (e.g., lock bolt, plunger) from one position (e.g., locked position) to another position (e.g., unlocked position), the solenoid component can utilize power to generate a desired amount of force, which can be applied to the solenoid plunger and thereby to the lock pin to move or transition the lock pin from the current position (e.g., current state) to the desired position (e.g., desired or target state). The lock component can be employed with virtually any type of door, such as swinging doors, sliding doors, etc.

In another aspect, the lock component can comprise a sensor component that can sense (e.g., detect) when power to the lock component, or at least the solenoid component, will be lost or otherwise compromised (e.g., compromised to a point below a predefined minimum threshold power level, or a power level determined to be undesirably fluctuating based at least in part on the predefined operation criteria). If the sensor component senses that power will be lost or compromised and the lock pin is not in the desired position for power off condition, prior to the power off condition (e.g., loss of power, compromised power) occurring, an operation controller component, which can be associated with the sensor component, can automatically transmit a signal to the solenoid component that the power will be lost or compromised—that is, a power off condition is impending. In response to the received indication, the solenoid component can automatically generate and apply a force to the solenoid plunger and thereby to the lock pin to automatically transition the lock pin from the current position (e.g., unlocked position) to the desired position (e.g., locked position) in accordance with the predefined operation criteria. After the lock pin is moved to the desired position, the holder component, which is associated with the desired position, can apply a desired amount of force to the solenoid plunger and thereby to the lock pin (e.g., magnetic force attracting the solenoid plunger), without using power, so that the lock pin can remain in the desired position (e.g., locked position) even though there is no power (or undesirably fluctuating power) being supplied to the lock component. If the lock pin is in the desired position (e.g., locked position) for power off condition, when the solenoid component receives an indication from the operation controller component that the power will be lost or compromised, the solenoid component can employ the desired holder component to apply a desired force to the solenoid plunger and thereby to the lock pin to maintain (e.g., hold) the lock pin in the desired position in relation to the lock receptacle in accordance with the predefined operation criteria (e.g., criteria specifying the desired position of the lock pin during power off conditions), while the lock component is in the power off condition.

In still another aspect, the lock component can include or be associated with a secondary (e.g., auxiliary) power supply that can provide power to the lock component and/or other components associated with the lock component for up to a desired amount of time during power off condition. For example, the secondary power supply can provide power to the solenoid component so that the solenoid component can generate a desired force to be applied to the solenoid plunger and the associated lock pin to transition the lock pin from a current position to a desired position, for example, after an impending power off condition is sensed but the power off condition occurs before the lock pin is transitioned to the desired position during the power off condition or if it is desired to transition the lock pin from a current position to a desired position while the lock component is subject to the power off condition with regard to the primary power supply.

In yet another aspect, the lock component can include or be associated with an authentication component that can be employed to facilitate securing the lock component with regard to programming of the lock component, such as, for example, programming the lock component to have the lock pin transition or be placed in a desired position (e.g., locked position) during a power off condition and/or programming the lock component to have the lock pin transition or be placed in a default position during a power on condition. The authentication component can request and/or receive authentication credentials (e.g., password, passcode, personal identification number (PIN), biometric information associated with a user, etc.) from a user and can compare the authentication credentials to authentication information stored in a data store associated with the authentication component. If the authentication credentials of a user match corresponding stored authentication credentials, the authentication credentials can be validated and specified access rights to a program component associated with the lock component can be granted to the user, and the user can program desired lock pin positions during respective power conditions (e.g., desired lock position when the lock is under a power on condition; desired lock position when the lock is under a power off condition) and/or in response to a detected change in power conditions. If the authentication credentials of a user do not match stored authentication credentials, the authentication can be determined to be not valid and access to a program component can be denied to the user.

The following description and the annexed drawings set forth certain illustrative aspects of the specification. These aspects are indicative, however, of but a few of the various ways in which the principles of the specification can be employed. Other advantages and novel features of the specification will become apparent from the following detailed description of the specification when considered in conjunction with the drawings.

DETAILED DESCRIPTION

Figure 1:
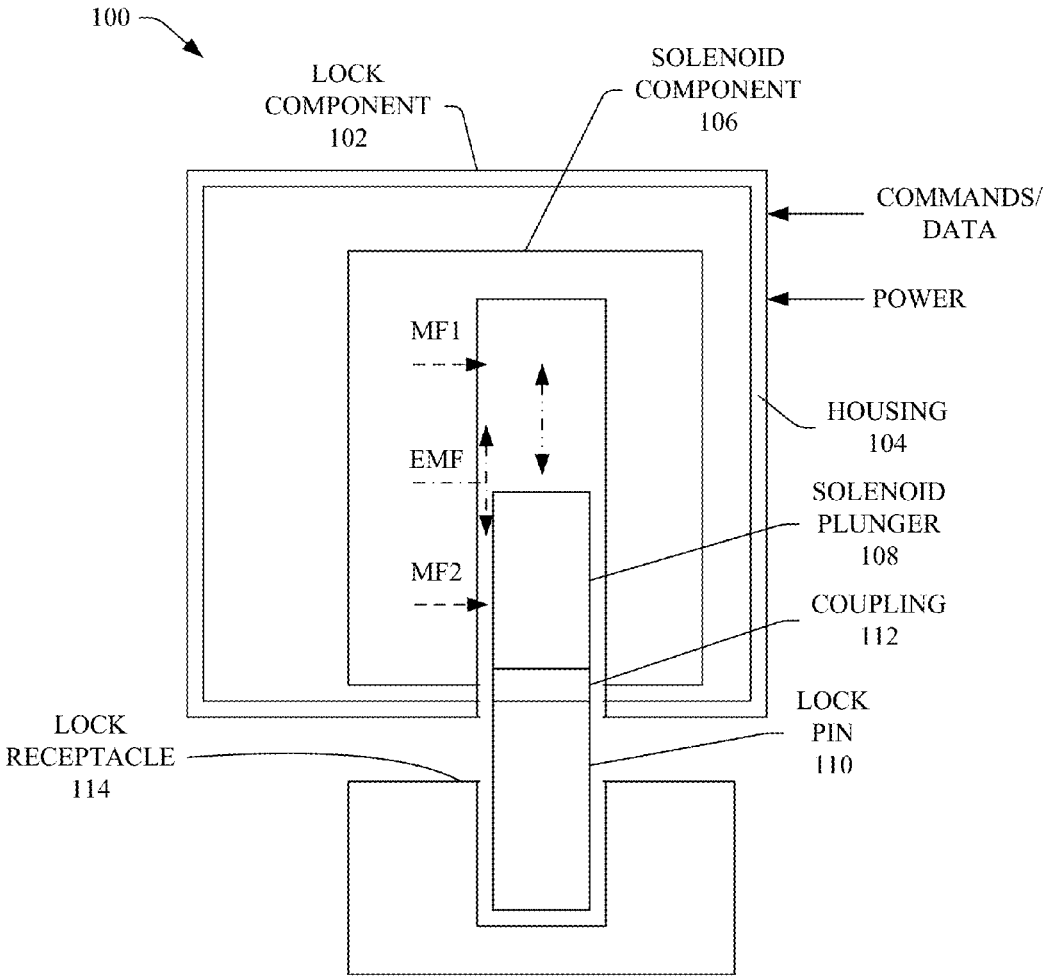
FIG. 1 illustrates a cross-section diagram of an example system that can efficiently control the operating state of a lock component under power on and power off conditions in accordance with various aspects and embodiments of the disclosed subject matter.

The disclosed subject matter is now described with reference to the drawings, wherein like reference numerals are used to refer to like elements throughout. In the following description, for purposes of explanation, numerous specific details are set forth in order to provide a thorough understanding of the disclosed subject matter. It can be evident, however, that the disclosed subject matter can be practiced without these specific details. In other instances, well-known structures and devices are shown in block diagram form in order to facilitate describing the disclosed subject matter.

As used in this application, the terms "component," "module," "object", "system," or the like can refer to hardware (e.g., lock housing, lock pin, magnet, etc.) and/or a computer-related entity, either hardware, a combination of hardware and software, software, or software in execution. For example, a component can be, but is not limited to being, a process running on a processor, a processor, an object, an executable, a thread of execution, a program, and/or a computer. By way of illustration, both an application running on a controller and the controller can be a component. One or more components can reside within a process and/or thread of execution and a component can be localized on one computer and/or distributed between two or more computers. As another example, an interface can include I/O components as well as associated processor, application, and/or API components.

In certain instances, electromagnetic locks are used to secure (e.g., lock) a door associated with a defined physical area (e.g., room, secured production area, etc.). Conventional electromagnetic locks require power to hold the door in a locked position as power is required by such electromagnetic locks in order to generate the force required to hold the door in the locked position or state. When power to such an electromagnetic lock is lost or otherwise disrupted, the lock can lose its holding force and the lock no longer can secure the door in the locked position. Further, a conventional electromagnetic lock can use a significant amount of power and generate a significant amount of heat due to the lock requiring a constant power supply to maintain the lock in the locked position. It is desirable to be able to transition and/or maintain a lock, such as an electromagnetic lock, in a desired position (e.g., locked position) during a power off condition (e.g., when there is a loss or disruption of power to the lock). It is also desirable to improve efficiency of the lock by, for example, reducing power consumption of the lock and/or reducing heat generated by the lock.

Systems, methods, and devices that efficiently control the operating state (e.g., locked position, unlocked position) of a lock (e.g., an electromagnetic lock) under power on and power off conditions are presented. In an aspect, a lock component (e.g., electromagnetic lock) can include a solenoid component (e.g., bi-stable latching solenoid) that can be attached to a door frame, for example, and can hold a lock pin in a locked or unlocked position, for example, in relation to a lock receptacle (e.g., lock plate) associated with (e.g., attached to or constructed in) a door attached to the door frame, without using power to hold the lock pin in the desired position. For instance, the solenoid component can comprise at least a first holder component and a second holder component, wherein the first holder component can apply a desired amount of force (e.g., magnetic force) on a solenoid plunger, which can be desirably attached or coupled to the lock pin via a coupling, to thereby apply a force on the lock pin, wherein the solenoid plunger can have at least a portion that is formed of a ferromagnetic material that can be attracted to and/or held by the force, to hold the solenoid plunger and thereby hold the lock pin in a first position (e.g., unlocked position) without using power, and the second holder component can apply a desired amount of force (e.g., magnetic force) to the solenoid plunger and thereby to the lock pin to hold the lock pin in a second position (e.g., locked position), at respective desired times, and in accordance with predefined operation criteria. When it is desired to transition from one position (e.g., locked position) to another position (e.g., unlocked position), the solenoid component can utilize power to generate and apply a desired amount of force to the solenoid plunger and thereby to the lock pin to move or transition the lock pin from the current position to the desired position.

In another aspect, the lock component can comprise a sensor component that can sense (e.g., detect) when power to the lock component, or at least the solenoid component, will be lost or otherwise compromised. If the sensor component senses that power will be lost or compromised (e.g., compromised to a point below a predefined minimum threshold power level, or a power level determined to be undesirably fluctuating based at least in part on predefined operation criteria) and the lock pin is not in the desired position for power off condition, the solenoid component can receive an indication that the power will be lost or compromised and can automatically generate and apply a force to the solenoid plunger and the associated lock pin to automatically transition (e.g., automatically switch) the lock pin from the current position (e.g., unlocked position) to the desired position (e.g., locked position) before the power off condition occurs. The lock component can remain in the desired position (e.g., locked position) even though there is no power (or undesirably fluctuating power) being supplied to the lock component. if the lock pin is in the desired position (e.g., locked position) for power off condition, when the solenoid component receives an indication that the power will be lost or compromised, the solenoid component can maintain the lock pin in the desired position without using power to do so, while the lock component is in the power off condition (e.g., loss of power or undesirably fluctuating power condition).

Now referring to FIG. 1, illustrated is a cross-section diagram of an example system 100 that can efficiently control the operating state (e.g., locked position, unlocked position) of a lock component (e.g., an electromagnetic lock) under power on and power off conditions in accordance with various aspects and embodiments of the disclosed subject matter. The system 100 can comprise a lock component 102 that can be utilized to secure or lock a door associated with a defined area, such as a room, for example. The lock component 102 can comprise a housing 104 that can be used to hold various other components of the lock component 102, such as those components disclosed herein. The housing 104 can be formed of virtually any desired type of material(s) (e.g., metal, polymer-based material, etc.).

In an aspect, the lock component 102 can comprise a solenoid component 106 (e.g., bi-stable latching solenoid) that can comprise a solenoid plunger 108 that can be desirably attached or connected to a lock pin 110 (e.g., lock bolt) via a coupling 112, wherein the solenoid plunger 108, the lock pin 110, and/or the coupling 112 can be placed in a recess or chamber formed or constructed in the solenoid component 106. The recess or chamber can be shaped and sized such that the solenoid plunger 108, the lock pin 110, and/or the coupling 112 can be inserted therein and the solenoid plunger 108 and lock pin 110 connected thereto can be moved between desired positions (e.g., positioned such that no portion or a relatively small portion of the lock pin 108 is residing outside of the recess or chamber (e.g., unlocked position); positioned such that a relatively larger portion of the lock pin 108 resides outside of the recess or chamber (e.g., locked position)) by applying desired force (e.g., magnetic force, electromagnetic force) in a desired direction to the solenoid plunger 108 to facilitate moving the lock pin 110 in a desired direction in relation to the recess or chamber. When placing the lock pin 110 in the locked position, the lock pin 110 can engage and/or be inserted in a lock receptacle 114 (e.g., a hole in a lock plate) to facilitate locking a door (e.g., a door having the lock receptacle 114 attached thereto) and holding the door in a desired position (e.g., closed position) with respect to the entrance way associated with the door and defined physical area. For instance, the lock component 102 can be attached to the door frame and the lock receptacle 114 can be attached to the door, or other suitable place in relation to the lock component 102; or alternatively, the lock receptacle 114 can be attached to the door frame, and the lock component 102 can be attached to the door or other suitable place in relation to the lock receptacle 114.

In an aspect, the solenoid plunger 108 can be formed, at least in part, of metal, such as a ferromagnetic metal, to facilitate applying a force (e.g., attracting magnetic force) to the solenoid plunger 108 to hold the solenoid plunger 108, and thus, also hold the lock pin 110 connected to the solenoid plunger 108 in a desired position, or applying a transition force (e.g., electromagnetic force) to the solenoid plunger 108 to move the solenoid plunger 108, and thus, move the associated lock pin 110, from a current position to a desired position in response to the magnetic or electromagnetic forces being applied to the solenoid plunger 108. The solenoid plunger 108, lock pin 110, and coupling 112 each can have a desired shape (e.g., cylindrical, square or rectangular shaped pin, etc.), wherein, for example, the respective shape of the lock pin 110 can correspond to the shape of the hole (e.g., circular, square, or rectangular, etc.) of the lock receptacle 114, or can be a different shape, but the respective shapes and sizes of the solenoid plunger 108, lock pin 110, and coupling 112 are such that the solenoid plunger 108, lock pin 110, and/or coupling 112 are able to be inserted in the recess of the solenoid component 106, the lock pin position of the lock pin 110 is able to be controlled by the solenoid component 106, and the lock pin 110 is still able to engage and be inserted into the hole of the lock receptacle 114. It is to be appreciated and understood that, while the solenoid plunger 108, lock pin 110, and coupling 112 are depicted in FIG. 1 as having a same or similar width or diameter, the subject specification is not so limited, as the solenoid plunger 108, lock pin 110, and coupling 112 can have same or different widths or diameters with respect to each other, as desired. For example, if desired, the solenoid plunger 108 can have a relatively thin shaft, while the lock pin 110 can have a thicker or wider shaft.

In an aspect, the coupling 112 can be formed of a desirable material (e.g., metal) and can provide a desirably flexible or relatively loose connection between the solenoid plunger 108 and lock pin 110. This flexible or relatively loose connection by the coupling 112 can facilitate protecting the solenoid plunger 108 from undesired forces (e.g., forces applied in the direction of the side of the solenoid plunger 108) being applied to the solenoid plunger 108, for example, when a shear force is applied to the side of the lock pin 110 (e.g., when someone pulls on the door while the lock pin 110 is in the locked position, there can be force applied to the side of the lock pin 110 when the lock pin 110 is pushed or pulled against the lock receptacle 114). When a shear force is applied to the lock pin 110, the coupling 112 can be flexible or loose enough so that the shear force, or at least a desired amount of the shear force, is not transferred to the solenoid plunger 108 to facilitate maintaining the integrity of the solenoid plunger 108 (e.g., to facilitate not bending the shaft of the solenoid plunger 108). The connection provided by the coupling 112 to the solenoid plunger 108 and lock pin 110 is strong enough to enable the lock pin 110 to be held in a desired position (e.g., first or unlocked position, second or locked position), or be transitioned between positions, in response to a holding force or transition force applied to the solenoid plunger 108. That is, the holding force or transition force, or at least a desired portion thereof, can be transferred from the solenoid plunger 108, or correspondingly applied by the solenoid plunger 110, to the lock pin 110 via the coupling 112 to facilitate holding or moving the lock pin 110, as desired.

In an embodiment, the lock component 102 can be an electromagnetic lock that can comprise or generate magnetic forces (e.g., first magnetic force (MF1) associated with a first or an unlocked position, or second magnetic force (MF2) associated with a second or locked position), which can be applied to the solenoid plunger 108 to hold and/or latch the lock pin 110 in a desired position (e.g., unlocked position, locked position) without consuming power to do so. The adhesive force for holding the solenoid plunger 108, and thus, holding the lock pin 110, in a desired position does not depend on a power-generated electromagnetic force generated by a solenoid, due in part to the locking of the lock component 102 with respect to the lock receptacle 114 being in the shear direction. The lock component 102 also can generate and apply an electromagnetic force (EMF) to the solenoid plunger 108 to transition the solenoid plunger 108, and thus, transition the lock pin 110, from a current position to a different position with respect to the lock receptacle 114 to place the lock pin 110 in a locked state or an unlocked state (e.g., to lock or unlock the associated door). The lock receptacle 114 can be formed of metal and/or other desired material(s) having a desired amount of strength to facilitate securely holding the door in the closed position with respect to a door frame when the lock pin 110 is in the locked position (e.g., when the lock pin 110 is engaging or is otherwise inserted in the hole in the lock receptacle 114). As desired, the lock component 102 can be attached to the door frame or the door, and the lock receptacle 114 can be attached to the other of the door frame or the door which is not attached to the lock component 102.

In an aspect, the solenoid component 106 (e.g., solenoid actuator) can apply a desired amount of force (e.g., magnetic force) to the solenoid plunger 108, and thus, the lock pin 110, to hold the lock pin 110 in a locked position, when desired, or an unlocked position, when desired, with respect to the lock receptacle 114, without using or requiring power (e.g., electrical power) from a power supply. As a result, when there is a power off condition with respect to the lock component 102 (e.g., when power to the lock component is detected to be lost or otherwise compromised), the solenoid component 106 is able to apply a desired amount of force (e.g., magnetic force) to the solenoid plunger 108, and thus, the lock pin 110, to hold the lock pin 110 (e.g., magnetically attract the solenoid plunger 108 to hold the lock pin 110) in the desired position (e.g., locked position when specified by the predefined operation criteria; or unlocked position when specified by the predefined operation criteria) with respect to the lock receptacle 114, without consuming power in order to do so. Further, during power on condition, the solenoid component 106 is able to hold the solenoid plunger 108, and thus, the lock pin 110, in a desired position without consuming power in order to hold the lock pin 108 in the desired position, with respect to the lock receptacle 114, which can result in reduction in power consumption by the lock component 102, reduction in heat generated by the lock component 102, and reduction in operating costs.

Figure 4:
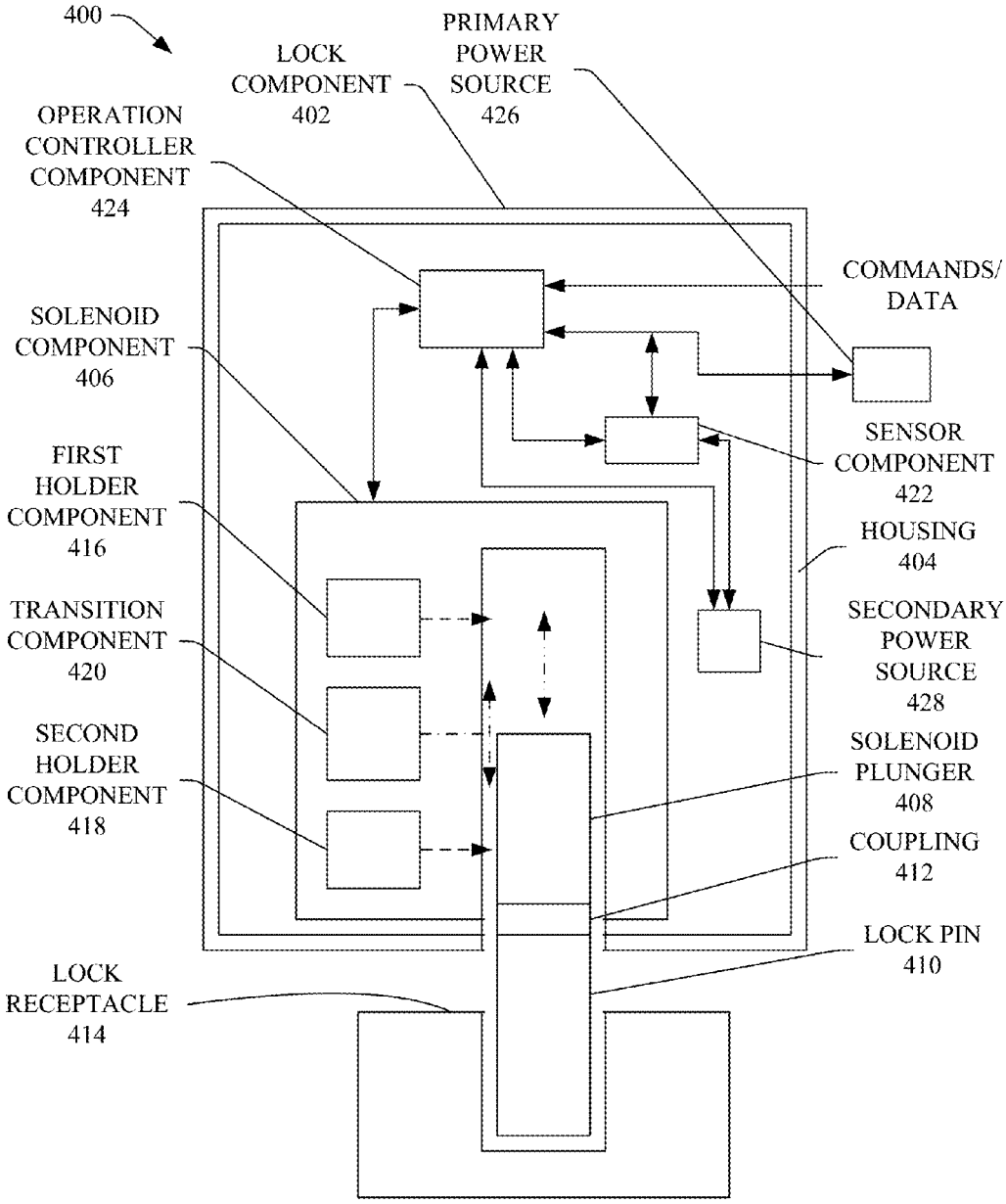
FIG. 4 depicts a cross-section diagram of an example system that can efficiently control the operating state of a lock component under power on and power off conditions in accordance with an aspect of the disclosed subject matter.
Figure 5:
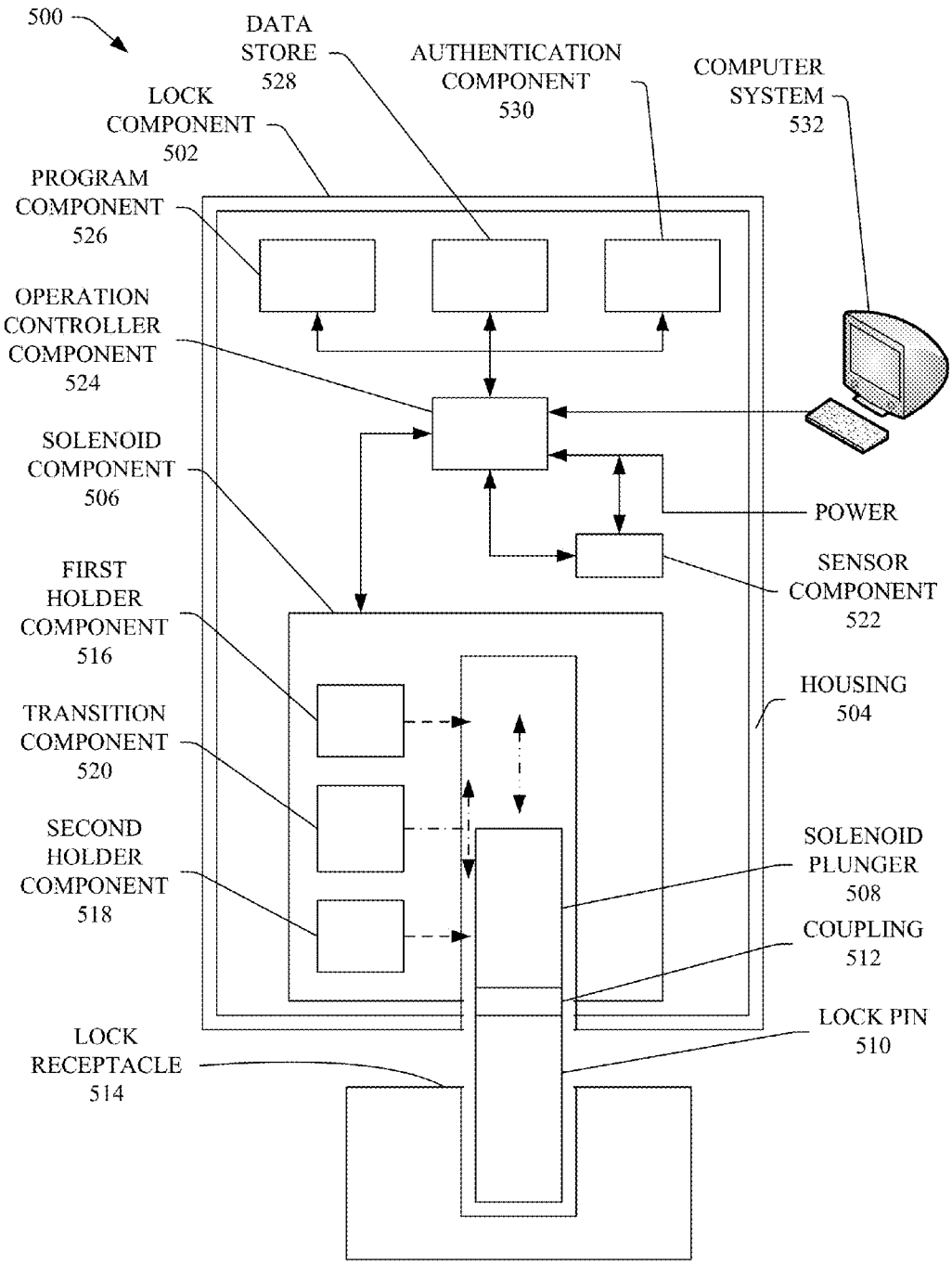
FIG. 5 illustrates a cross-section diagram of an example system that can program a lock component to facilitate operation of the lock component in accordance with an aspect of the disclosed subject matter.

The solenoid component 106 also can transition (e.g., switch) the solenoid plunger 108, and thus, the lock pin 110, from a current position (e.g., unlocked position) to a different position (e.g., locked position) in relation to the lock receptacle 114, as desired. When transitioning the solenoid plunger 108 and associated lock pin 110 from a current position to a different position, the solenoid component 106 can receive power from a power supply (not shown in FIG. 1; e.g., as shown in FIG. 4) to facilitate generating and apply a desired amount of force (e.g., electromagnetic force) to the solenoid plunger 108, and thereby the lock pin 110, to move or transition the solenoid plunger 108, and thereby the lock pin 110, from the current position to the desired position in relation to the lock receptacle 114. In an aspect, the solenoid component 106 can employ a coil or other desired component (not shown in FIG. 1 for reasons of brevity and clarity) to which power can be applied to facilitate generating and applying a force (e.g., electromagnetic force) in a desired direction to facilitate transitioning the solenoid plunger 108 and associated lock pin 110 in a desired direction to a desired position. After the lock pin 110 is transitioned to the desired position, the use of power by the solenoid component 106 for facilitating transition of the lock pin 110 to the desired position can be discontinued, and the solenoid component 106 can hold the solenoid plunger 108 and associated lock pin 110 in the desired position without consuming power in order to do so. In an aspect, the transitioning (e.g., automatic transitioning) of the lock pin 110 between the first position and the second position can be performed in response to a command (e.g., a command received from a computer system (not shown in FIG. 1; as shown in FIG. 5) that facilitates controlling operations associated with the lock component 102) or automatically performed in response to a detected power off condition in accordance with the predefined operation criteria. In an aspect, the lock component 102 can be programmed in accordance with the predefined operation criteria, so that the solenoid plunger 108 and associated lock pin 110 are held in and/or transitioned to respective desired positions under respective power on conditions and power off conditions, such as more fully disclosed herein.

As a result, the features of the subject specification can control the operating state (e.g., locked state, unlocked state) of the lock component 102 in a stable manner (e.g., via a bi-stable latching solenoid) under power on and power off conditions and can self-lock (e.g., to act as a safety switch) when a power off condition is detected (when desired or specified by the predefined operation criteria), in contrast to conventional locking systems. The features of the subject specification can provide improved safety, as compared to conventional locking systems, as the features of the subject specification can maintain desired functionality for the lock component 102 when loss of power to the lock component 102 is detected, and self-latching of the lock component 102 (when desired or specified by the predefined operation criteria) when a power off condition is detected further can prevent a change in operation state under power off conditions. Further, the features of the subject specification can provide for reduced power consumption associated with operating the lock component 102 and also can thereby reduce cost to operate the lock component 102, and can provide for reduction in the amount of heat generated by the lock component 102, as compared to power consumption, operating cost and heat generated by conventional locking systems. Furthermore, the lock component 102 does not require conventional mechanical parts, such as key recognizer module, rotating mechanism, or spring loaded plunger, to operate, and the lock component 102 can provide more flexibility in operation than conventional lock devices (e.g., lock component can be transitioned into a locked position or an unlocked position, whichever position is desired in accordance with the predefined operation criteria, in response to a detected change in the power conditions (e.g., power on to power off condition, or power off to power on condition)). Moreover, with regard to installation, the features of the subject specification do not require new or different brackets to accommodate different kinds of doors, such as swinging doors, sliding doors, etc., which can result in cost savings.

Figure 2:
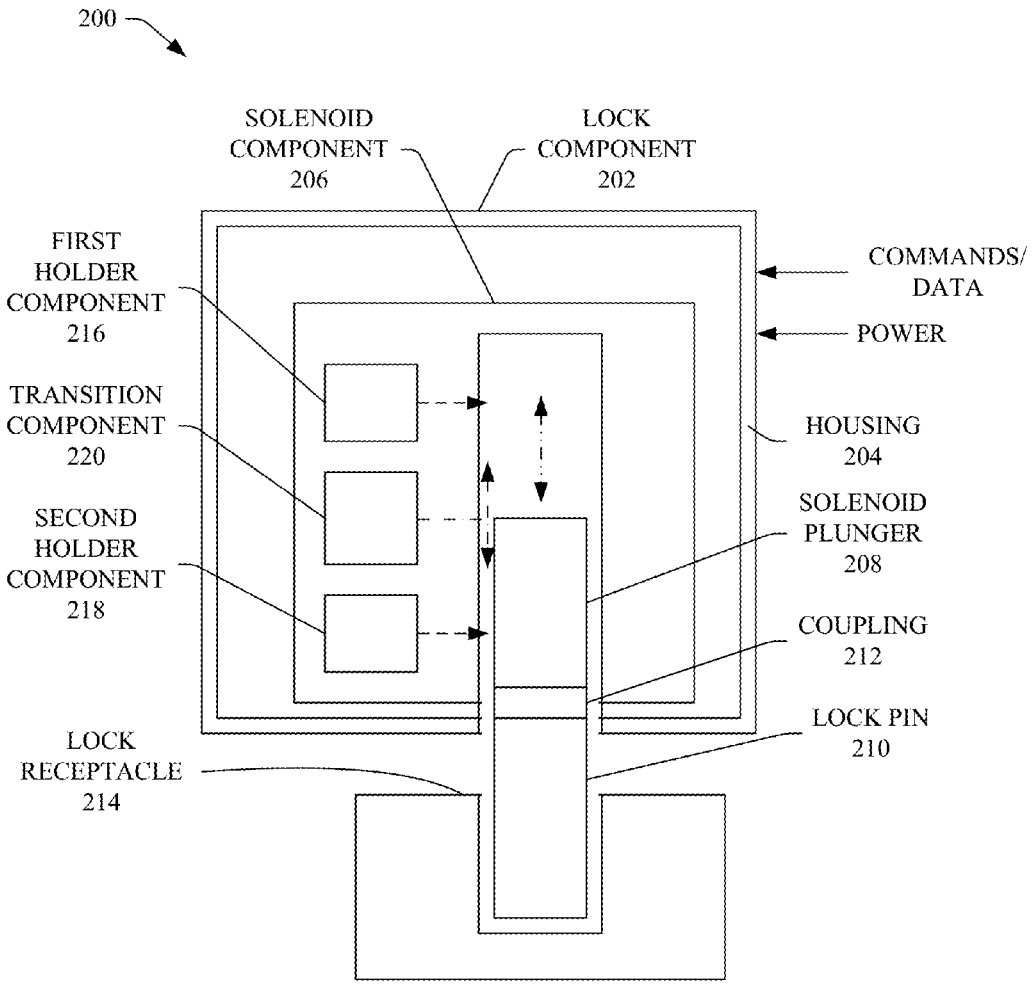
FIG. 2 illustrates a cross-section diagram of an example system that can employ a solenoid component to efficiently control the operating state of a lock component under power on and power off conditions in accordance with an aspect of the disclosed subject matter.

FIG. 2 depicts a cross-section diagram of an example system 200 that can employ a solenoid component (e.g., bi-stable latching solenoid) to efficiently control the operating state of a lock component under power on and power off conditions in accordance with an aspect of the disclosed subject matter. The system 200 can include a lock component 202 that can be utilized to secure or lock a door associated with a defined physical area, such as a room or secured production area, for example. The lock component 202 can comprise a housing 204 that can contain components of the lock component 202. The lock component 202 can include a solenoid component 206 that can be employed to apply a desired force to a solenoid plunger 208, which can be desirably connected to a lock pin 210 via a coupling 212, all of which can be part of or associated with the solenoid component 206, to hold the lock pin 210 in desired positions (e.g., first or locked position, second or unlocked position) in relation to a lock receptacle 214 and can apply a desired transition force to the solenoid plunger 208 to move the associated lock pin 210 from a current position to a different position. The lock pin 210 can be employed to engage or disengage the lock receptacle 214, which can be associated with a door (or other suitable place in relation to the lock component 102), to facilitate locking or unlocking the door, respectively, associated with a door frame to which the lock component 202 can be attached, as desired. In an alternate embodiment, the lock component 202 can be attached to a door, and the lock receptacle 214 can be attached to the associated door frame (or other suitable place in relation to the lock receptacle 214). The lock component 202, housing 204, solenoid component 206, solenoid plunger 208, lock pin 210, coupling 212, and lock receptacle 214, each can be the same or similar as, and/or can comprise the same or similar functionality as, respective components (e.g., respectively named components), such as more fully described herein, for example, with regard to system 100, system 300, system 400, system 500, methodology 700, methodology 800, methodology 900, and methodology 1000.

In an aspect, the solenoid component 206 can comprise a first holder component 216 that can apply a desired amount of force (e.g., magnetic force) to the solenoid plunger 208 to hold the solenoid plunger 208, to thereby hold the lock pin 210 in a first position, such as an unlocked position, where the lock pin 210 can be held in a position such that it is disengaged from the lock receptacle 214, which can allow the door to be moved about its hinge, track, etc., to open or close the door, as desired. In an embodiment, the first holder component 216 can be or can comprise a magnet having sufficient magnetic force (e.g., attracting magnetic force with respect to the solenoid plunger 208) and being positioned in relation to (e.g., positioned in close proximity to) the solenoid plunger 208 when the solenoid plunger 208 and thus, the lock pin 210 is in the first position such that the first holder component 216 can hold the solenoid plunger 208 to thereby hold the lock pin 210 in the first position without other force being applied to the solenoid plunger 208 or associated power being supplied (e.g., a force requiring electrical power) to hold (e.g., maintain) the solenoid plunger 208 and associated lock pin 210 in the first position.

In another aspect, the solenoid component 206 can include a second holder component 218 that can apply a desired amount of force (e.g., magnetic force) to hold the solenoid plunger 208, and thus, hold the lock pin 210 in a second position, such as a locked position, where the solenoid plunger 208 and associated lock pin 210 can be held such that the lock pin 210 is engaged with the lock receptacle 214 (e.g., an end portion of the lock pin 210 is inserted in the lock receptacle 214), which can lock and hold the associated door in place with respect to the door frame so that the door cannot be moved about its hinge, track, etc. In an embodiment, the second holder component 218 can be or can comprise a magnet having sufficient magnetic force (e.g., attracting magnetic force with respect to the solenoid plunger 208) and being positioned in relation to (e.g., positioned in close proximity to) the solenoid plunger 208 when the solenoid plunger 208 and associated lock pin 210 are in the second position such that the second holder component 218 can hold the solenoid plunger 208 and associated lock pin 210 in the second position without other force being applied to the solenoid plunger 208 or associated power being supplied (e.g., a force requiring electrical power) to hold (e.g., maintain) the solenoid plunger 208 and associated lock pin 210 in the second position. As a result, the solenoid plunger 208 and lock pin 210 can be held or maintained in the second (e.g., locked) position to keep the door locked during power on conditions without consuming power and during power off conditions associated with the lock component 202, when desired. The system 200, by employing the lock component 202, can thereby reduce power consumption, reduce operating costs, and reduce the amount of heat generated by the lock, as compared to conventional lock systems. Further, by employing the solenoid component 206 (e.g., bi-stable latching solenoid), the lock component 202 can be less sensitive to shock and vibrations with respect to lock operations, as compared to conventional lock devices.

In still another aspect, the solenoid component 206 can comprise a transition component 220 that can be employed to transition (e.g., move) the solenoid plunger 208 and thereby transition the lock pin 210 between at least the first position and the second position, as desired and/or in accordance with the predefined operation criteria. In an aspect, the transition component 220 can be associated with (e.g., electrically connected to) a power supply (not shown in FIG. 2; e.g., as shown in FIG. 4), wherein the power supply can provide the transition component 220 a desired amount of power to facilitate transitioning the solenoid plunger 208 and lock pin 210 between the first and second position.

In an aspect, the lock pin 210 can be placed in a desired position or transitioned from a current position to a desired position in response to a received command (e.g., lock command, unlock command) or in response to a detected power off condition (or detected power on condition) in accordance with the predefined operation criteria. For example, a command can be received from a computer system (not shown in FIG. 2; as shown in FIG. 5) or other computer device or lock controller device, which is employed to control operations associated with the lock component 202 and has data processing functionality. In an aspect, the lock component 202 can be programmed in accordance with the predefined operation criteria, so that the solenoid plunger 208 and associated lock pin 210 are held in and/or transitioned to respective desired positions under respective power on conditions and power off conditions, such as more fully disclosed herein.

When it is desired to transition the lock pin 210 from one position (e.g., unlocked position) to another position (e.g., locked position), the transition component 220 can generate a desired amount of force (e.g., electromagnetic force) that can be applied in a desired direction to the solenoid plunger 208, wherein the amount of force can be sufficient to overcome the force of the holder component (e.g., first holder component 216 or second holder component 218) associated with the current position (e.g., first position or second position) of the lock pin 210 (e.g., holding the solenoid plunger 208 and lock pin 210 in the current position), and can transition the solenoid plunger 28 and thereby the lock pin 210 from the current position to the desired position. While the transition component 220 is generating and applying a force to the solenoid plunger 208 during the transition phase, the transition component 220 can receive a desired amount of power from the power supply sufficient to generate the desired amount of force. When the transition is completed to move the lock pin 210 to the desired position, the transition component 220 no longer requires power from the power supply at least for purposes of transitioning the lock pin 210. The holder component (e.g., first holder component 216 or second holder component 218) associated with the new current position can apply a desired amount of force to the solenoid plunger 208 to hold the lock pin 210 in the new current position without the need for power being supplied, for example, from a power supply. At this point, as desired, the lock component 202 can function to maintain the lock pin 210 in the current position without consuming power from the power supply.

If it is desired to transition the lock pin 210 from the new current position to the prior position, for example, in response to a received transition command or a detected power off condition (or detected power on condition, while in a power off condition) when in accordance with the predefined operation criteria, the transition component 220 can utilize power from the power supply that is sufficient for the transition component 220 to generate and apply a desired amount of force (e.g., electromagnetic force) to the solenoid plunger 208, where the force can be in the opposite direction than the force associated with the prior transition, and where the force is sufficient in magnitude to overcome the holding force of the holder component associated with the new current position, so that the solenoid plunger 208 and associated lock pin 210 are moved from the new current position to the prior position. At this point, the force from the transition component 220 can be discontinued, and the force applied by the holder component associated with the now current position of the lock pin 210 can be sufficient to hold the solenoid plunger 208 and thereby the lock pin 210 in that desired position without the need for power from a power supply. Also, at this point, the lock component 202, including the transition component 220, can discontinue using power at least for the purpose of holding the lock pin 210 in the now current position.

Figure 3:
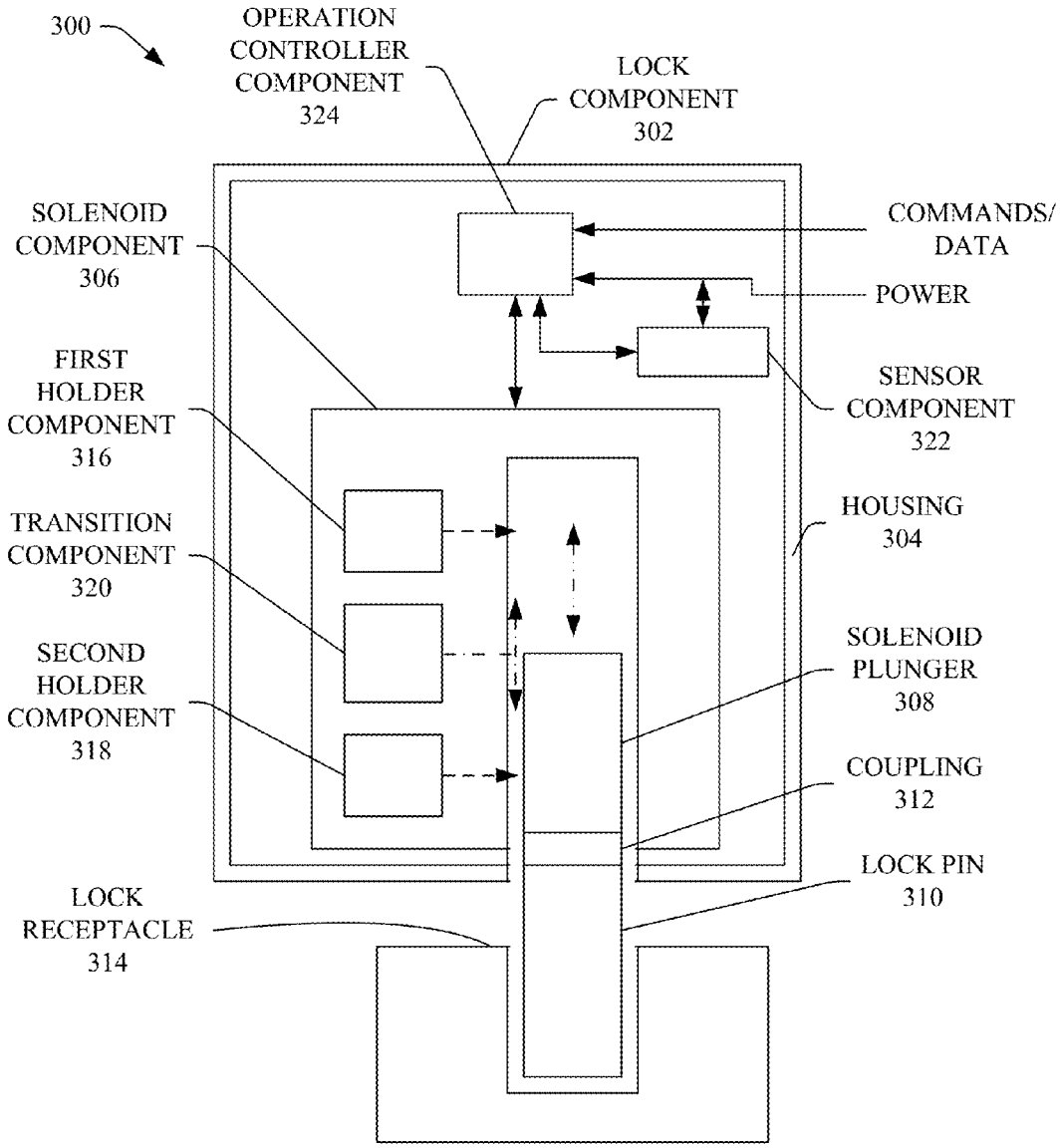
FIG. 3 illustrates a cross-section diagram of an example system that can sense power conditions associated with a lock component to facilitate efficiently controlling the operating state of the lock component in accordance with an aspect of the disclosed subject matter.

In another aspect, the lock pin 210 can be transitioned from a current position (e.g., unlocked position) to a desired position (e.g., locked position) in relation to the lock receptacle 214 in accordance with the predefined operation criteria. For example, when an impending power off condition is sensed by the lock component 202 (e.g., sensor component (not shown in FIG. 2; as shown in FIGS. 3-5), the transition component 220 can automatically receive a signal or indicator that can automatically trigger the transition component 220 to automatically generate and apply a desired amount of force on the solenoid plunger 208 and thereby on the lock pin 210 to automatically transition the lock pin 210 from the current position to the desired position associated with a power off condition. As desired, a holder component (e.g., second holder component 218) associated with the desired position can apply a desired amount of force on the solenoid plunger 208 to thereby hold the lock pin 210 in the desired position in relation to the lock receptacle 214 without using or requiring power to do so.

FIG. 3 illustrates a cross-section diagram of an example system 300 that can sense power conditions associated with a lock component to facilitate efficiently controlling the operating state of the lock component in accordance with an aspect of the disclosed subject matter. The system 300 can include a lock component 302 that can be utilized to secure or lock a door associated with a defined physical area, such as a room or secured production area, for example. The lock component 302 can comprise a housing 304 that can contain components of the lock component 302. The lock component 302 can include a solenoid component 306 that can be employed to apply a desired force to a solenoid plunger 308, which can be connected to a lock pin 310 using a coupling 312, all of which can be part of or associated with the solenoid component 306, to hold the solenoid plunger 308 and thereby hold the lock pin 310 in respective desired positions (e.g., first or locked position, second or unlocked position) in relation to a lock receptacle 314 at respective given times and can apply a desired transition force in a desired direction to move the solenoid plunger 308 and thereby move the lock pin 310 from a current position to a different position in relation to the lock receptacle 314. The lock pin 310 can be employed to engage or disengage the lock receptacle 314, which can be associated with a door , to facilitate locking or unlocking the door, respectively, associated with a door frame to which the lock component 302 can be attached, as desired. In an alternate embodiment, the lock component 302 can be attached to a door, and the lock receptacle 314 can be attached to the door frame (or other suitable place in relation to the lock receptacle 314).

The solenoid component 306 can include a first holder component 316 and second holder component 318 to facilitate holding the solenoid plunger 308 and associated lock pin 310 in respectively associated positions (e.g., unlocked position, locked position) without consuming power, for example, from a power supply, and can further include a transition component 320 that can transition the solenoid plunger 308 and associated lock pin 310 between at least a first position (e.g., unlocked position) and second position (e.g., locked position) to facilitate unlocking or locking the lock component 302, and thus, the door associated therewith. The lock component 302, housing 304, solenoid component 306, solenoid plunger 308, lock pin 310, coupling 312, lock receptacle 314, first holder component 316, second holder component 318, and transition component 320 each can be the same or similar as, and/or can comprise the same or similar functionality as, respective components (e.g., respectively named components), such as more fully described herein, for example, with regard to system 100, system 200, system 400, system 500, methodology 700, methodology 800, methodology 900, and methodology 1000.

In an aspect, the lock component 302 can comprise a sensor component 322 (e.g., sensor, reading head) that can be associated with the power supply (e.g., external or primary power supply, internal or secondary power supply) that provides power to the lock component 302. The sensor component 322 can monitor the power conditions associated with the lock component 302 to facilitate determining whether the power conditions meet predefined operation criteria relating, for example, to amount of power provided to the lock component 302, power stability (e.g., whether the amount of power provided to the lock component 302 or other power characteristics (e.g., voltage, current, etc.) are undesirably erratic, wherein, for example, voltage or current can be fluctuating in an undesirable manner), etc. While monitoring power conditions associated with the lock component 302, the sensor component 322 can sense (e.g., detect) when a loss or other disruption (e.g., loss of power stability) of power to the lock component 302 (or a component(s) therein), is about to occur or has occurred, thereby indicating a power off condition is about to or has occurred, and the sensor component 322 can automatically send a signal or indicator (e.g., power off signal or indicator) relating to change in power conditions (e.g., change from a power on condition to a power off condition) to an operation controller component 324 associated with (e.g., connected to) the sensor component 322.

In another aspect, the sensor component 322 also can sense when a power off condition associated with the lock component 302 is changing to a power on condition (e.g., when the power conditions associated with the lock component 302 are sufficiently good so as to meet the predefined operation criteria). When the sensor component 322 senses that the power condition is changing from a power off condition to a power on condition, the sensor component 322 can automatically transmit a signal or indicator (e.g., power on signal or indicator) to the operation controller component 324 indicating the power condition is changing from a power off condition to a power on condition.

In still another aspect, the operation controller component 324 can receive the power-off signal or indicator, or power-on signal or indicator, from the sensor component 322, and can automatically take a desired action with regard to operations of the lock component 302 based at least in part on the particular signal or indicator received and predefined operation criteria. For instance, the operation controller component 324 can receive a power off signal (e.g., indicating that a power off condition will occur) from the sensor component 322 and can automatically take a predefined action, such as automatically transmitting a signal or command to the solenoid component 306, and transition component 320 therein, to automatically transition the lock pin 310 (e.g., by applying a desired force to the solenoid plunger 308) from the first position (e.g., unlocked position) to the second position (e.g., locked position) to lock the door, prior to the time the power off condition actually occurs, or at least after the power off condition occurs (e.g., using secondary power supply or power that was previously accumulated by the solenoid component 306), based at least in part on the predefined operation criteria, when the predefined operation criteria specifies that such automated action is to occur when a power off condition is detected. The second holder component 318 is able to hold the solenoid plunger 308 and associated lock pin 310 in the second position to engage the lock pin 310 in and latch the lock pin 310 to the lock receptacle 314 without using or requiring power in order to do so, thereby securing the associated door and the defined area associated therewith. The lock component 302, by employing the solenoid component 306 (e.g., bi-stable latching solenoid) can thereby be self-locking under power off conditions—when the locked position is the desired position under power off conditions in accordance with the predefined operation criteria.

In accordance with various aspects, while under a power off condition, the operation controller component 324 and/or other components can be in a powered down or sleep mode, wherein no lock operations (e.g., transitions between lock pin position) take place, or a remote system, such as computer system (not shown in FIG. 3; e.g., as shown in FIG. 5), can facilitate performing desired operations while the lock component is under power off conditions.

As another example, the lock component 302 can be operating under a power off condition. The sensor component 322 can sense or detect a power on condition is about to occur, and can transmit a signal to the operation controller component 324 indicating a power on condition is impending. In response to the detected power on condition, as desired, the operation controller component 324 can automatically transmit a signal to the solenoid component 306 to facilitate automatically transitioning the lock pin 310 to a desired position associated with a power on condition (e.g., by applying a desired amount of force in the desired direction to the solenoid plunger 308), if not already in that desired position, and/or can automatically set up and/or resume normal operations associated with a power on condition for the lock component 302.

As desired, the lock component 302 can be programmed, as more fully disclosed herein, to automatically take other desired actions in addition to, or as an alternative to, automatically transitioning the lock pin 310 from the first position (e.g., unlocked position) to the second position (e.g., locked position) to lock the door, in accordance with the predefined operation criteria. For example, the lock component 302 can be programmed such that, in response to a power off condition, the lock component 302 can automatically apply a desired amount of force in a desired direction to the solenoid plunger 308 to transition the lock pin 310 from the first position to the second position, or can maintain the lock pin 310 in the second position when it is already in the second position, and can further operate to not allow the lock pin 310 to transition from the second position to the first position, when the lock component 302 is in a power off condition with respect to a primary power supply (e.g., primary power source), even when a secondary power supply (e.g., secondary power source) is in a power on condition in relation to the lock component (e.g., at all times when the secondary power supply is supplying the power to the lock component, or only when the available power of the secondary power supply has dropped below a predefined minimum amount of power, as desired). Other examples can relate to programming the lock component 302 to specify what operational state (e.g., locked position, unlocked position) is to be the default position associated with a power on condition, what operational state the lock component 302 is to be placed in after a power off condition changes to a power on condition, etc.

FIG. 4 depicts a cross-section diagram of an example system 400 that can efficiently control the operating state of a lock component under power on and power off conditions in accordance with an aspect of the disclosed subject matter. The system 400 can include a lock component 402 that can be utilized to secure or lock a door associated with a defined area, such as a room, for example. The lock component 402 can comprise a housing 404 that can contain components of the lock component 402. The lock component 402 can include a solenoid component 406 that can be employed to apply a desired force to a solenoid plunger 408, which can be desirably connected to a lock pin 410 via a coupling 412, all of which can be part of or associated with the solenoid component 406, to hold the solenoid plunger 408 and associated lock pin 410 in respective desired positions (e.g., first or locked position, second or unlocked position) in relation to a lock receptacle 414, and/or can apply a desired transition force to move the solenoid plunger 408 and thereby the lock pin 410 from a current position to a different position in relation to the lock receptacle 414 in response to a command by the lock component 402 or in response a detected power off condition (or detected power on condition) in accordance with the predefined operation criteria. The lock pin 410 can be employed to engage or disengage the lock receptacle 414 associated with a door (or other suitable place in relation to the lock component 402) to facilitate locking or unlocking the door, respectively, associated with a door frame to which the lock component 402 can be attached, as desired. In an alternate embodiment, the lock component 402 can be attached to a door, and the lock receptacle 414 can be attached to the door frame (or other suitable place in relation to the lock receptacle 414). The solenoid component 406 can include a first holder component 416 and second holder component 418 to facilitate holding the solenoid plunger 408 and thereby the lock pin 410 in respectively associated positions (e.g., unlocked position, locked position) without consuming power, for example, from a power supply, and a transition component 420 that can transition the solenoid plunger 408 and thereby the lock pin 410 between a first position (e.g., unlocked position) and second position (e.g., locked position) to facilitate unlocking or locking the lock component 402, and thus, the door associated therewith.

In another aspect, the lock component 402 can comprise a sensor component 422 that can monitor power conditions associated with the lock component 402 and can sense when a change in power condition associated with the lock component 402 is about to occur (e.g., can sense when a power on condition is about to change to a power off condition prior to such change occurring). The lock component 402 also can include an operation controller component 424 associated with other components, such as the sensor component 422 and solenoid component 406, of the lock component 402, wherein the operation controller component 424 can control operations associated with the lock component 402. The lock component 402, housing 404, solenoid component 406, solenoid plunger 408, lock pin 410, coupling 412, lock receptacle 414, first holder component 416, second holder component 418, transition component 420, sensor component 422, and operation controller component 424 each can be the same or similar as, and/or can comprise the same or similar functionality as, respective components (e.g., respectively named components), such as more fully described herein, for example, with regard to system 100, system 200, system 300, system 500, methodology 700, methodology 800, methodology 900, and methodology 1000.

In an aspect, the lock component 402 can be associated with (e.g., electrically connected to) one or more power supplies, such as a primary power source 426 and/or a secondary power source 428 (e.g., auxiliary power source), where the one or more power supplies can provide the components (e.g., transition component 420) of the lock component 402 a desired amount of power to facilitate controlling the functions of the lock component 402, including, for example, transitioning the solenoid plunger 408 and thereby the lock pin 410 between the first position (e.g., unlocked position) and second position (e.g., locked position). In an embodiment, the primary power source 426 can be associated with an electrical grid to facilitate generating and providing the desired power to the lock component 302 and components therein. The secondary power source 428 can be a battery (e.g., single use battery; re-chargeable battery, such as a lithium-type battery) or other similar or suitable type of power supply, which can be employed when the primary power source 426 is disconnected from, or is otherwise unable to provide the desired power to, the lock component 402 (and thus, the solenoid component 406, including the transition component 420). It is to be appreciated and understood that, in accordance with various other embodiments, the primary power source 426 can be a different type of power supply (e.g., battery) than disclosed hereinabove and the secondary power source 428 can be a different type of power supply (e.g., power from an electrical grid) than disclosed hereinabove. It is to be further appreciated and understood that, while the primary power source 426 is depicted as being external to the lock component 402 and the secondary power source 428 is depicted as being within the lock component 402, the subject disclosure is not so limited, as, in accordance with various embodiments, the both the primary power source 426 and secondary power source 428 can be external to the lock component 402, or both can be contained inside the lock component 402, or the primary power source 426 can be contained inside the lock component 402 and the secondary power source 428 can be external with respect to the lock component 402, as desired.

In an aspect, the sensor component 422 can be associated with (e.g., connected to) the primary power source 426 and secondary power source 428, wherein the sensor component 422 can monitor power conditions associated with the primary power source 426 and secondary power source 428 in relation to the lock component 402. As desired, the sensor component 422 can monitor the secondary power source 428 continuously or periodically (e.g., regardless of whether the secondary power source 428 is being used), or to reduce power consumption, the sensor component 422 can monitor the secondary power source 428 (e.g., continuously or periodically) only when the secondary power source 428 is being utilized (e.g., when the lock component 402 is experiencing a power off condition with respect to the primary power source 426). When the sensor component 422 detects a power off condition is about to occur between the lock component 402 and primary power source 426, the sensor component 422 can automatically transmit a signal (e.g., power off signal) to the operation controller component 424 to indicate that a power off condition has been detected.

In another aspect, when the predefined operation criteria specifies that the lock component 402 is to be in the locked state when a power off condition occurs with respect to a power off condition associated with the primary power source 426 (and/or secondary power source 428) is about to occur, the operation controller component 424 can transmit (e.g., automatically transmit) a signal or command to the solenoid component 406, and transition component 420 therein, to facilitate having the solenoid component 406 transition (e.g., automatically transition) the lock component 402 to the power off state (e.g., locked position), for example, when the lock pin 410 is not already in the desired power off state. In response to receiving the signal or command from the operation controller component 424, if the lock pin 410 is in the unlocked position, the solenoid component 406 can transition the solenoid plunger 408 and thereby transition the lock pin 410 from the unlocked position to the locked position in relation to the lock receptacle 44; and if the lock pin 410 is in the locked position, the solenoid component 406 can maintain the solenoid plunger 408 and thereby maintain the lock pin 410 in the locked position, without consuming power.

In still another aspect, if a lock component is associated with a secondary power source, such as lock component 402 that includes secondary power source 428, the operation controller component 424 can facilitate switching (e.g., automatically switching) from the primary power source 426 to the secondary power source 428, while the power off condition exists between the lock component 402 and the primary power source 426. The secondary power source 428 can provide desired power to all or at least a portion of the components of the lock component 402.

As desired, predefined operation criteria can specify that the lock pin 410 is to be placed in a power off state (e.g., locked position) during a power off condition associated with the primary power source 426 and remain there until a power on condition exists between the lock component 402 and primary power source 426, even if the secondary power source 428 can provide sufficient power to the transition component 420 to transition the solenoid plunger 408 and thereby transition the lock pin 410 between the locked position and unlocked position; or can specify that the lock pin 410 is to be placed in a power off state (e.g., locked position), at least initially, during a power off condition associated with the primary power source 426, but the lock component 402 can transition between the locked and unlocked positions (e.g., in response to a received command), wherein the secondary power source 428 can provide sufficient power to the transition component 420 to transition the solenoid plunger 408 and thereby transition the lock pin 410 between the locked position and unlocked position, for example, as long as the secondary power source 428 has sufficient power to provide to the transition component 420 to facilitate transition of the lock pin 410 between positions, or until the available amount of power of the secondary power source 428 is below a predefined minimum threshold amount of power, after which the lock pin 410 is to be transitioned to the locked position with respect to the lock receptacle 414 and remain there until there is a power on condition between the lock component 402 and primary power source 426 (or other predefined operation criteria is met (e.g., an emergency situation where it is desirable to be able to transition the lock component 402 to the unlocked position, even under a power off condition (e.g., where there is auxiliary power available for such transition or other means by which to facilitate such transition)).

In an aspect, while the power off condition associated with the primary power source 426 exists, the sensor component 422 can continue to monitor power conditions between the lock component 402 and the primary power source 426. When the sensor component 422 senses that a power on condition is re-established between the lock component 402 and primary power source 426, the sensor component 422 can transmit a power on signal to the operation controller component 424, and, in response to receiving the power on signal from the sensor component 422, the operation controller component 424 can facilitate switching from the secondary power source 428 to the primary power source 426 so that the primary power source 426 is again providing power to the lock component 402 to facilitate enabling the lock component 402 to perform desired operations. In an embodiment, if the secondary power source 428 is a re-chargeable battery, the operation controller component 426 can facilitate enabling the secondary power source 428 to receive power from the primary power source 426 to re-charge the secondary power source 428.

Referring to FIG. 5, illustrated is a cross-section diagram of an example system 500 that can program a lock component to facilitate operation of the lock component in accordance with an aspect of the disclosed subject matter. The system 500 can include a lock component 502 that can be utilized to secure or lock a door associated with a defined area, such as a room, for example. The lock component 502 can comprise a housing 504 that can contain components of the lock component 502. The lock component 502 can include a solenoid component 506 that can be employed to apply a desired force to a solenoid plunger 508, which can be desirably connected or coupled to a lock pin 510 via a coupling 512, all of which can be part of or associated with the solenoid component 506, to hold the solenoid plunger 508 and associated lock pin 510 in respective desired positions (e.g., first or locked position, second or unlocked position) in relation to a lock receptacle 514, and/or can apply a desired transition force to move the solenoid plunger 508 and thereby move the associated lock pin 510 from a current position to a different position in relation to the lock receptacle 514 in response to a command by the lock component 502 or in response a detected power off condition (or detected power on condition) in accordance with the predefined operation criteria. The lock pin 510 can be employed to engage or disengage the lock receptacle 514 associated with a door to facilitate locking or unlocking the door, respectively, with respect to a door frame to which the lock component 502 can be attached, as desired. In an alternate embodiment, the lock component 502 can be attached to a door, and the lock receptacle 514 can be attached to the door frame (or other suitable'place in relation to the lock component 502). The solenoid component 506 can include a first holder component 516 and second holder component 518 to facilitate holding the solenoid plunger 508 and thereby holding the lock pin 508 in respectively associated positions (e.g., unlocked position, locked position) without consuming power, for example, from a power supply, and a transition component 520 that can transition the solenoid plunger 508 and associated lock pin 510 between a first position (e.g., unlocked position) and second position (e.g., locked position) to facilitate unlocking or locking the lock component 502, and thus, the door associated therewith.

In another aspect, the lock component 502 can comprise a sensor component 522 that can monitor power conditions associated with the lock component 502 and can sense when a change in power condition associated with the lock component 502 is about to occur (e.g., can sense when a power on condition is about to change to a power off condition prior to such change occurring). The lock component 502 also can include an operation controller component 524 associated with other components, such as the sensor component 522 and solenoid component 506, of the lock component 502, wherein the operation controller component 524 can control operations associated with the lock component 502. The lock component 502, housing 504, solenoid component 506, solenoid plunger 508, lock pin 510, coupling 512, lock receptacle 514, first holder component 516, second holder component 518, transition component 520, sensor component 522, and operation controller component 524 each can be the same or similar as, and/or can comprise the same or similar functionality as, respective components (e.g., respectively named components), such as more fully described herein, for example, with regard to system 100, system 200, system 300, system 400, methodology 700, methodology 800, methodology 900, and methodology 1000.

In an aspect, the lock component 502 can comprise a program component 526, which can be associated with the operation controller component 524, and can be employed to enable the lock component 502 to be programmed to facilitate having the lock component 502 operate in accordance with the predefined operation criteria. For example, the program component 526 can receive program instructions from a user (e.g., manufacturer, programmer, end user), wherein the program instructions can indicate desired operating states of the lock component in relation to detected power conditions associated with the lock component 502, time of day, day of week, user who is using or attempts to use the lock component 502, etc. The program component 526 can store the program instructions and/or information related thereto in a data store 528 associated with the program component 526. During operation of the lock component 502, the program component 526 and/or the operation controller component 524 (e.g. processor, microprocessor, or controller) can retrieve program instructions or information from the data store 528, and the operation controller component 524 can use such instructions or information to facilitate identifying or determining a desired operational state the lock component 502 is to be in based at least in part on current conditions (e.g., power on condition, power off condition) associated with the lock component 502.

For example, the program component 526 can receive program instructions providing that the lock pin 510 is to be placed or transitioned (e.g., automatically transitioned) to a locked position with respect to the lock receptacle 514 when a power off condition associated with the power supply (e.g., primary power source and/or secondary power source) is sensed by the sensor component 522. Such program instructions can be stored in the data store 528. When the sensor component 522 senses a power off condition associated with the lock component 502 is about to occur, and sends (e.g., automatically transmits) a signal to the operation controller component 524, the program component 526 or operation controller component 524 can retrieve the program instructions and/or information related thereto from the data store 528 (or the program instructions and/or information can be retrieved and loaded into desired storage (e.g., volatile memory) at when the lock component 502 is powered on), and the operation controller component 524 can use the instructions and/or information to identify or determine that, during a power off condition, the lock pin 510 is to transition or be placed in a locked position in relation to the lock receptacle 514 (e.g., the lock pin 510 is to be inserted into the lock receptacle 514) to lock the door.

In accordance with an aspect, the lock component 502 can include an authentication component 530 that can be used to facilitate securing the lock component 502 and controlling access to the lock component 502, including the program component 526. The authentication component 530 can facilitate denying access to the lock component 502, including the program component 526, unless valid authentication credentials are presented to the lock component 502. When a user attempts to access the program component 526, for example, to program and/or change the programming of the lock component 502, the authentication component 530 can facilitate prompting the user to enter authentication credentials, which can be a password, passcode, personal identification number (PIN), biometric information (e.g., fingerprint, eye scan, etc.), etc., and the user can provide the authentication credentials to the lock component 502 via an interface (e.g., keypad, touch screen, pad or scanner for receiving or obtaining biometric information, etc.) configured to receive the authentication credentials from the user.

The operation controller component 524 and authentication component 530 can operate in conjunction with one another to evaluate (e.g., compare) the received authentication credentials to determine whether the authentication credentials are valid and a level of access the user is to be provided with regard to the lock component 502 if valid authentication credentials are provided. For instance, one or more approved authentication credentials can be stored in the data store 528, wherein respective approved authentication credentials can be associated with respective levels of access to the lock component 502. When authentication credentials are received from the user, the operation controller component 524 and/or authentication component 530 can retrieve one or more of the approved authentication credentials from the data store 528 and can compare the received authentication credentials to the one or more approved authentication credentials to determine whether the received authentication credentials are valid. If the operation controller component 524 and/or authentication component 530 determine that the received authentication credentials are not the same as any of the approved authentication credentials, the operation controller component 524 and/or authentication component 530 can deny access to the lock component 502 to the user. If the operation controller component 524 and/or authentication component 530 determine that the received authentication credentials match one of the approved authentication credentials, the operation controller component 524 and/or authentication component 530 can identify or determine the level of access to the lock component 502 based at least in part on the received authentication credentials and the predefined access criteria, which can be a subset of the predefined operation criteria. For example, one type of authentication credentials can be authorized to allow complete access to the program component 526 to program the lock component 502 as desired, and another type of authentication credentials can allow only a lower level of access to the program component 526, wherein the user is only able to perform a smaller subset of programming operations.

In an embodiment, the lock component 502 can be associated with (e.g., connected to) a computer system 532 that can be employed to facilitate controlling operation of the lock component 502, programming of the lock component 502, authentication of users who desire access to the lock component 502, etc. For example, the computer system 532 can be primarily or at least partially controlling operations associated with the lock component 502, and the computer system 532 can facilitate transmitting commands or signals to the solenoid component 506 to transition the solenoid plunger 508 and thereby transition the lock pin 510 between the first position and second position at desired times and/or in accordance with the predefined operation criteria.

In an embodiment, the computer system 532 can operate in conjunction with the operation controller component 524 or can perform all or a desired portion of the functions of the operation controller component 524. For example, in such embodiment, the sensor component 522 can monitor power conditions associated with the lock component 502 and/or the computer system 532, and/or can monitor connection conditions between the lock component 502 and computer system 532, and can sense when the lock component 502 and/or computer system 532 is about to experience a power off condition or when connection between the computer system 532 and lock component 502 is about to be lost or disrupted. In response to a sensed power off condition or connection loss/disruption, the computer system 532 and/or lock component 502 can take a desired automated action (e.g., place or transition the lock pin 510 into a desired position) in accordance with the predefined operation criteria. As desired, the computer system 532 also can facilitate authentication and programming associated with the lock component 502 (e.g., can perform functions associated with authentication and/or programming in conjunction with, or instead of, the operation controller component 524).

It is to be appreciated and understood that, while certain components (e.g., program component, authentication component) are depicted as being contained in the lock component 502, the subject disclosure is not so limited, and, in accordance with various embodiments, one or more components of the lock component 502 can be stand-alone components or contained in another component, such as computer system 532, or any suitable combination thereof.

Figure 6:
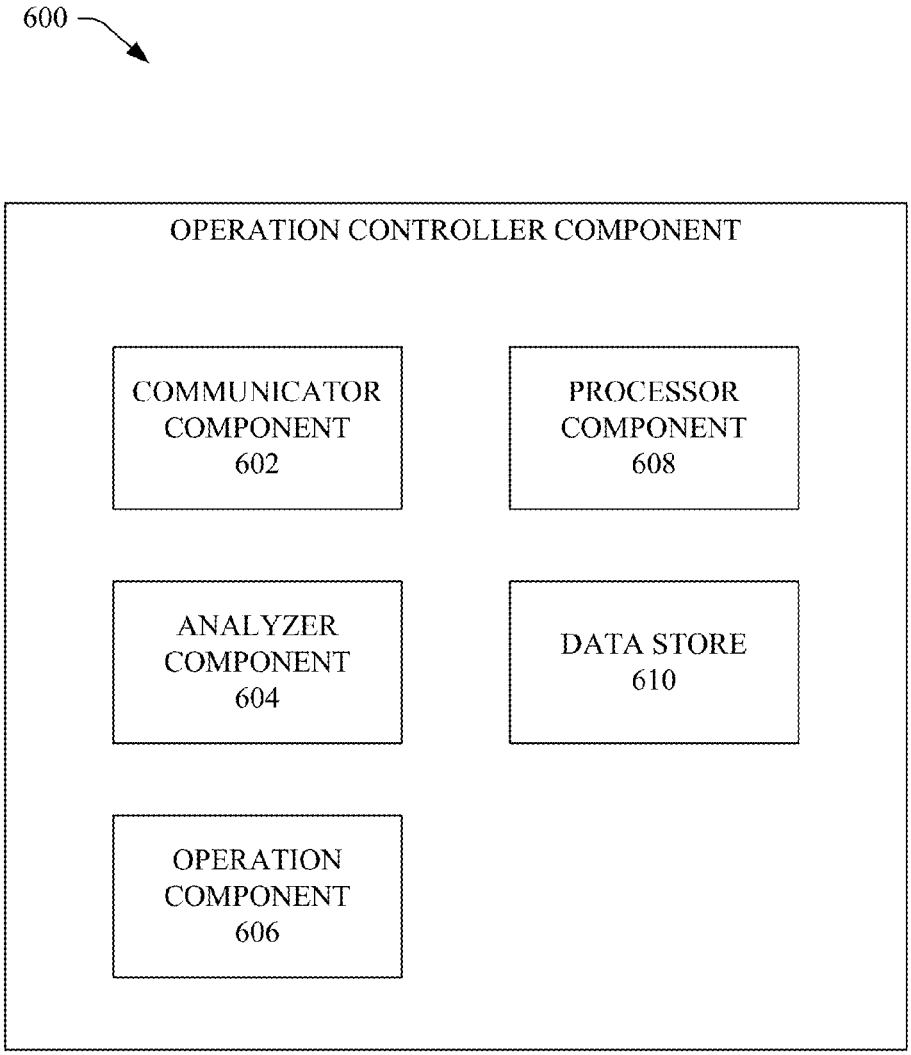
FIG. 6 illustrates a block diagram of an example operation controller component in accordance with an aspect of the disclosed subject matter.

FIG. 6 is a block diagram of an example operation controller component 600 in accordance with an aspect of the disclosed subject matter. In an aspect, the operation controller component 600 can include a communicator component 602 that can be employed to facilitate receiving or transmitting information (e.g., signals, indicators, commands, etc.) from or to other components associated with the operation controller component 600. For instance, the communicator component 602 can receive a power off signal from the sensor component indicating that the lock component is about to experience a power off condition with respect to the power supply, and the communicator component 602 can transmit a signal to the solenoid component to transition or place the solenoid plunger and thus transition or place the associated lock pin into the desired position (e.g., locked position) associated with the power off condition. As another example, the communicator component 602 can receive commands (e.g., lock command, unlock command, transition command, etc.) or signals from a computer system or other data processing device that controls at least a portion of the operations associated with the lock component associated with the operation controller component 600. As still another example, the communicator component 602 also can receive or transmit information relating to programming of the lock component or authorizing access to the lock component (e.g., program component therein).

In another aspect, the operation controller component 600 also can include an analyzer component 604 that can analyze information, including programming information, authentication credentials, operations-related information, and/or other information, to facilitate operating the lock component (e.g., transitioning the lock pin between position, programming the lock component, granting access to the lock component, etc.) in accordance with the predefined operation criteria. For example, the analyzer component 604 can receive a power off signal from the sensor component and can retrieve programming information (e.g., one or more rules based at least in part on predefined operation criteria) from the data store, and can analyze the programming information and power off signal to facilitate identifying or determining the operating state the lock component is to be in due to the power off condition that will be occurring. As another example, the analyzer component 604 can receive authentication credentials from a user and can retrieve one or more approved authentication credentials from the data store. The analyzer component 604 can evaluate or compare the authentication credentials and the one or more approved authentication credentials to facilitate determining whether the received authentication credentials are valid, wherein the authentication credentials can be valid if the authentication credentials match one of the approved authentication credentials.

In still another aspect, the operation controller component 600 can comprise an operation component 606 that can receive information based at least in part on the analyzed information and/or other information (e.g., command) to facilitate identifying or determining an operational state the lock component is to be in at a given time and/or given power conditions associated with the lock component. The operation component 606 can transmit control signals relating to operation of the lock component to desired components (e.g., sensor component, solenoid component, primary power source, secondary power source, etc.) of the lock component to facilitate controlling or setting the desired operation state (e.g., locked position, unlocked position) of the lock component based at least in part on current conditions (e.g., power off condition, power on condition, etc.) associated with the lock component.

In yet another aspect, the operation controller component 600 can include a processor component 608 that can work in conjunction with the other components (e.g., communicator component 602, analyzer component 604, operation component 606, etc.) to facilitate performing the various functions of the operation controller component 600. The processor component 606 can employ one or more processors, microprocessors, or controllers that can process data, such as information relating to operation of the lock component, predefined operation criteria and associated operation-related rules, monitoring or detecting power conditions associated with the lock component, analyzing or evaluating information relating to the lock component, signals relating to operation or conditions of the lock component, and/or parameter values relating to operation of the lock component, etc., to facilitate controlling operation of the lock component in accordance with the predefined operation criteria; and can control data flow between the operation controller component 600 and other components (e.g., computer, programming device, etc.) associated with the operation controller component 600.

The operation controller component 600 also can include a data store 610 that can store data structures (e.g., user data, metadata); code structure(s) (e.g., modules, objects, classes, procedures) or instructions; information relating to operation of the lock component, predefined operation criteria and associated operation-related rules, monitoring or detecting power conditions associated with the lock component, analyzing or evaluating information relating to the lock component, signals relating to operation or conditions of the lock component, etc., to facilitate controlling operation of the lock component in accordance with the predefined operation criteria, etc. In an aspect, the processor component 608 can be functionally coupled (e.g., through a bus) to the data store 610 in order to store and retrieve information desired to operate and/or confer functionality, at least in part, to the communicator component 602, analyzer component 604, operation component 606, and/or substantially any other operational aspects of the operation controller component 600.

It is to be appreciated and understood that some components are depicted in the figures in a block diagram form or substantially in a block diagram form. Such components can be structured in any of a number of various ways, all of which fall within the scope of the subject specification. Further, for reasons of clarity and brevity, the solenoid component, including the first holder component, second holder component and transition component, is shown as being on one side of the recess or chamber in which the lock pin can be inserted in and moved in and out; however, as desired, the solenoid component (and associated components) can be constructed such that it surrounds all sides of the lock pin, and/or the recess or chamber, wherein the lock pin can be placed and moved, can be formed in the solenoid component.

FIGS. 7-10 illustrate methodologies and/or flow diagrams in accordance with the disclosed subject matter. For simplicity of explanation, the methodologies are depicted and described as a series of acts. It is to be understood and appreciated that the subject innovation is not limited by the acts illustrated and/or by the order of acts, for example acts can occur in various orders and/or concurrently, and with other acts not presented and described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that the methodologies disclosed hereinafter (or at least portions thereof) and throughout this specification are capable of being stored on an article of manufacture to facilitate transporting and transferring such methodologies to computers or other processing devices. The term article of manufacture, as used herein, can encompass a computer program accessible from any computer-readable device, carrier, or media.

Figure 7:
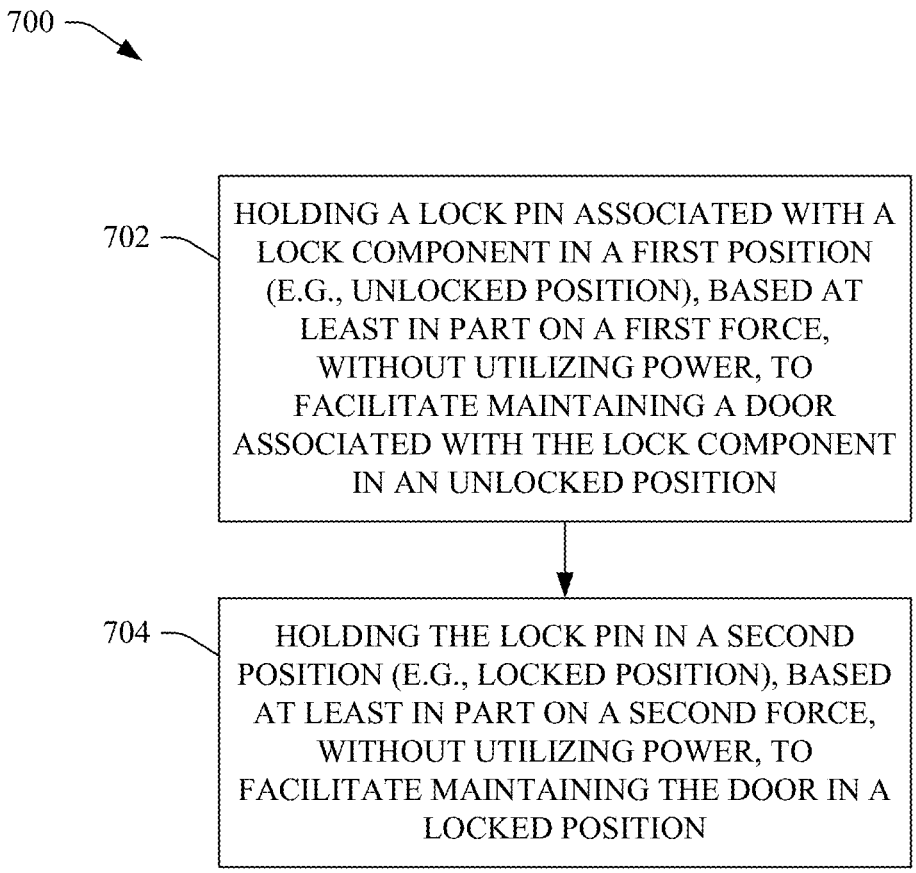
FIG. 7 illustrates a flowchart of an example methodology that can control operation of a lock component in accordance with various aspects and embodiments of the disclosed subject matter.

Now referring to FIG. 7, illustrated is an example methodology 700 that can control operation of a lock component in accordance with various aspects and embodiments of the disclosed subject matter. At 702, a lock pin associated with a lock component (e.g., electromagnetic lock) can be held in a first position (e.g., unlocked position), based at least in part on a first force, without utilizing power (e.g., without utilizing power to hold the lock pin in the first position), to facilitate maintaining a door associated with the lock component in an unlocked position. In an aspect, a lock component (e.g., electromagnetic lock) can be attached to a door frame and a lock receptacle (e.g., lock plate with a receptacle or hole therein) can be attached to a door, or vice versa. The lock component can include a solenoid plunger desirably connected to a lock pin via a coupling, wherein the lock pin can be employed to facilitate latching or locking the door, as, for example, in response to a desired force, the solenoid plunger can be desirably moved and correspondingly the lock pin can be moved from a first position (e.g., unlocked position), in which the lock pin is not engaged with or inserted in the lock receptacle, to a second position (e.g., locked position), in which the lock pin is moved or transitioned from the first position to the second position where the lock pin can be engaged with or inserted in the lock receptacle such that the door is locked and is not able to be opened.

In another aspect, while the lock pin is in the first position, the lock component can include a solenoid component that can employ a first holder component (e.g., magnet, such as a permanent magnet) that can apply a desired amount of force (e.g., magnetic force) to the solenoid plunger associated with the lock pin, wherein such force is strong enough to hold the solenoid plunger and associated lock pin in the first position. As a result, the lock component does not have to consume power in order to maintain the lock pin in the first position.

In still another aspect, the transition of the lock pin from the first position to the second position can be performed in response to a request or command to transition the lock pin to the second position or when a power off condition (e.g., loss or disruption of power to the lock component, undesirable fluctuation in power conditions associated with the lock component) is detected, for example, by a sensor component that monitors power conditions associated with the lock component, when a transition (e.g., automatic transition) to the second position during a detected power off condition is a desired response in accordance with the predefined operation criteria.

At 704, the lock pin can be held in a second position (e.g., locked position), based at least in part on a second force, without utilizing power, to facilitate maintaining the door in a locked position. As desired, or in accordance with the predefined operation criteria (when the criteria so specifies), the lock pin can be transitioned from the first position to the second position to facilitate putting the lock component in a locked state thereby locking the door. The solenoid component can comprise a transition component that can employ a desired amount of force (e.g., electromagnetic force) that is sufficient to overcome the force associated with the first holder component to move the solenoid plunger and thereby correspondingly move the lock pin from the first position in the direction of and to the second position. The power provided to the transition component to move the solenoid plunger and associated lock pin from the first position to the second position can be discontinued after the transition. The solenoid component can contain a second holder component (e.g., magnet) that can apply a desired amount of force to the solenoid plunger, wherein such force is strong enough to hold the solenoid plunger and associated lock pin in the second position, and wherein the second holder component does not have to be supplied power in order to apply the force to the solenoid plunger.

Figure 8:
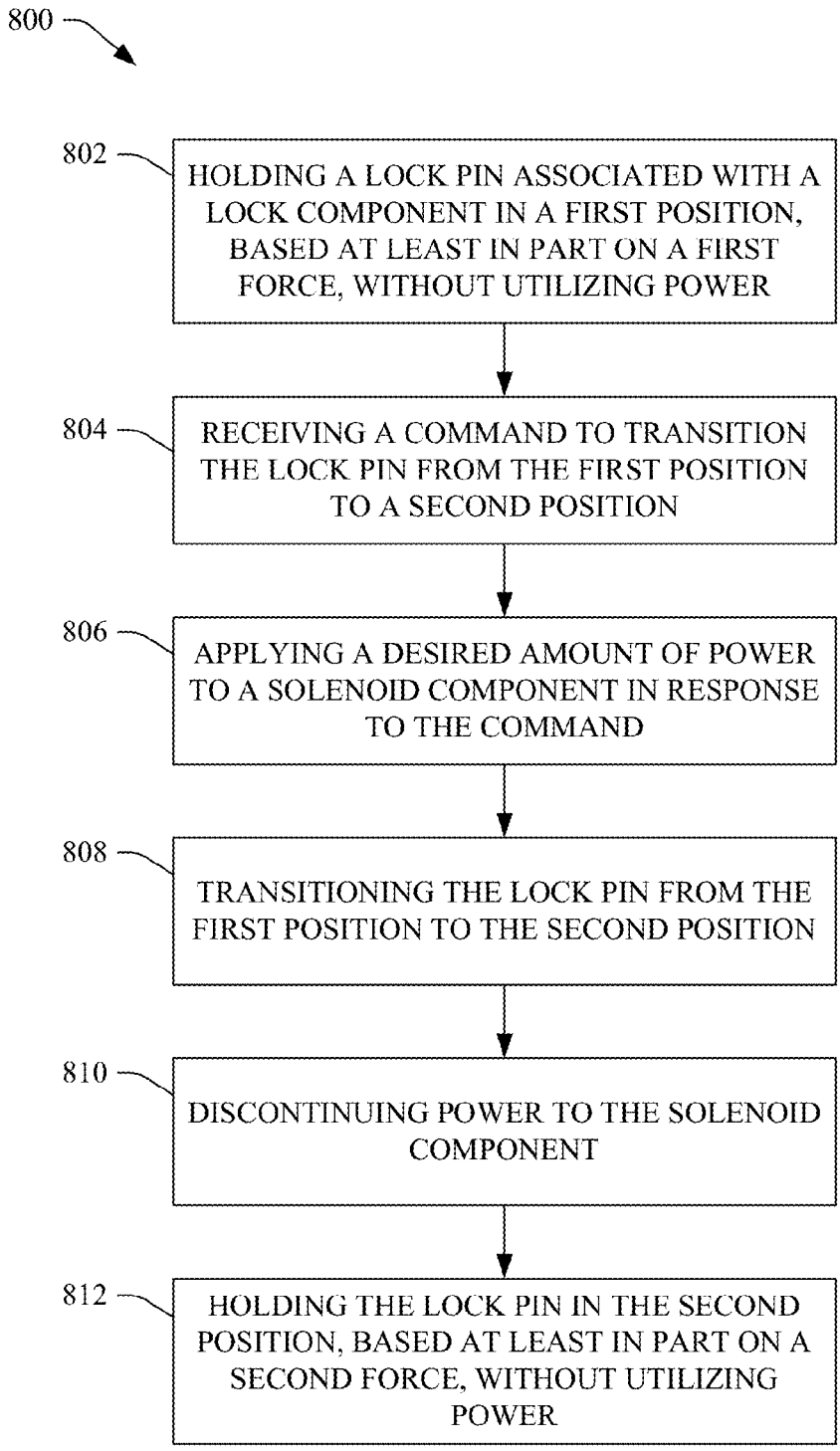
FIG. 8 depicts a flowchart of an example methodology that can control operation of a lock component in accordance with an aspect of the disclosed subject matter.

FIG. 8 depicts an example methodology 800 that can control operation of a lock component in accordance with an aspect of the disclosed subject matter. At 802, a lock pin associated with a lock component (e.g., electromagnetic lock) can be held in a first position (e.g., unlocked position), based at least in part on a first force, without utilizing power, to facilitate maintaining a door associated with the lock component in an unlocked position. In an aspect, a first force can be applied to a solenoid plunger that can be desirably connected to the lock pin using a coupling. The first force (e.g., magnetic force) can be applied to the solenoid plunger to attract and hold the solenoid plunger, and thereby hold the lock pin, in the first position in relation to a lock receptacle, without utilizing power to do so.

At 804, a command can be received to transition the lock pin from the first position to a second position (e.g., locked position). In an aspect, a command to transition the lock pin from the first position to the second position can be generated and communicated to the lock component, or a command or signal can be generated by the operation controller component in response to detection of a power off condition associated with the lock component is about to occur.

At 806, a desired amount of power can be applied to a solenoid component of the lock component in response to the command. A desired amount of power can be applied by a power supply to the solenoid component prior to the power off condition occurring (or by power accumulated by the solenoid component prior to the power off condition occurring; or if there is a secondary power supply and the power off condition associated with the primary power supply occurs before the transition of the lock pin, the desired power can be supplied to the solenoid component by the secondary power supply). The transition component of the solenoid component can use the applied power to generate and apply a desired amount of force (e.g., electromagnetic force) to the solenoid plunger, and thereby apply a desired amount of force to the lock pin, to facilitate transitioning (e.g., automatically transitioning) the lock pin from the first position to the second position.

At 808, the lock pin can be transitioned (e.g., automatically transitioned) from the first position to the second position. In an aspect, in response to the force applied by the transition component to the solenoid plunger, and consequently to the associated lock pin, the lock pin can move from the first position in the direction of and to the second position.

At 810, power to the solenoid component can be discontinued, for example, in relation to transitioning the lock pin to the second position. In an aspect, the power from the power supply, which is provided to the transition component to facilitate generating and applying a desired amount of force to the solenoid plunger and the associated lock pin to transition the lock pin from the first position to the second position, can be discontinued when the lock pin has been transitioned from the first position to the second position. At 812, the lock pin can be held in the second position (e.g., locked position), based at least in part on a second force, without utilizing power, to facilitate maintaining the door in a locked position. In an aspect, a second force can be applied to a solenoid plunger, which is desirably connected to the lock pin using a coupling. The second force (e.g., magnetic force) can be applied to the solenoid plunger to attract and hold the solenoid plunger, and thereby hold the lock pin, in the second position in relation to the lock receptacle, without utilizing power to do so.

It is to be appreciated and understood that methodology 800 can employ similar acts to those disclosed herein in order to transition the lock pin from the second position to the first position in response to a command (e.g., command received by the lock component or command generated by the operation controller component, for example, in response to a detected power off condition (or power on condition)).

Figure 9:
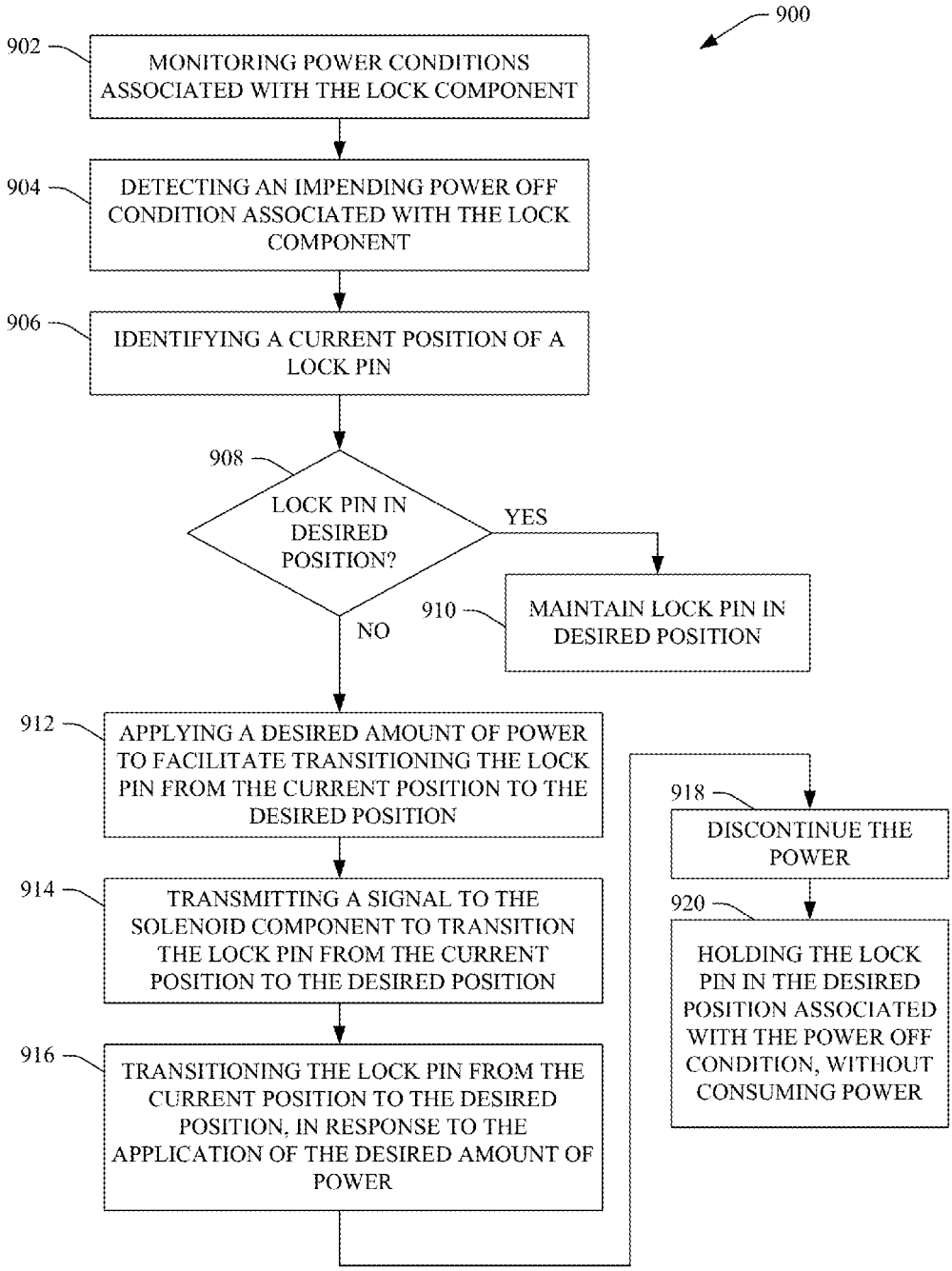
FIG. 9 illustrates a flowchart of an example methodology that can detect power conditions associated with a lock component to facilitate operation of the lock component in accordance with an aspect of the disclosed subject matter.

FIG. 9 illustrates an example methodology 900 that can detect power conditions associated with a lock component to facilitate operation of the lock component in accordance with an aspect of the disclosed subject matter. At 902, power conditions associated with the lock component can be monitored. In an aspect, the lock component can include a sensor component that can monitor power conditions associated with the lock component. The lock component can receive power from a primary power source and/or a secondary power source, and the sensor component can monitor the power conditions to facilitate sensing or detecting whether a power off condition is about to occur to the lock component due to a loss or disruption of power (or undesirable power fluctuations) from the primary power source (and/or secondary power source, when the secondary power source is being utilized by the lock component, for example).

At 904, an impending power off condition associated with the lock component can be detected. In an aspect, the sensor component can detect that a power off condition associated with the lock component is about to occur. The sensor component can transmit (e.g., automatically transmit) a signal (e.g., power off signal or indicator) to, for example, the operation controller component of the lock component. At 906, a current position of a lock pin can be identified. In an aspect, the operation controller component that can facilitate identifying a current position of the lock pin and/or a current position of the associated solenoid plunger.

At 908, a determination can be made regarding whether the lock pin is in the desired position based at least in part on the current position of the lock pin, the impending power off condition, and/or the predefined operation criteria. In an aspect, the operation controller component can determine whether the lock pin is in the desired position associated with an impending power off condition based at least in part on the current position of the lock pin (and/or associated solenoid plunger), the impending power off condition, and/or the predefined operation criteria.

If it is determined that the lock pin is in the desired position, at 910, the lock pin can be maintained in the desired position (e.g., second or locked position; or first or unlocked position) associated with a power off condition, without consuming power in order to maintain the lock pin in the desired position. The operation controller component can decide to take no action with regard to the lock pin when the operation controller component determines that the lock pin is already in the desired position associated with a power off condition.

If, at 908, it is determined that the lock pin is not in the desired position, at 912, a desired amount of power can be applied to facilitate transitioning (e.g., automatically transitioning or switching) the lock pin from the current position to the desired position. In an aspect, a desired amount of power can be provided to the transition component of the solenoid component by the power supply (e.g., primary power source) to facilitate transitioning the solenoid plunger, thereby transitioning the lock pin to the desired position in relation to the lock receptacle prior to the power off condition occurring (or after the power off condition occurs in relation to the primary power source, by employing a secondary power source to provide the desired power).

At 914, a signal can be transmitted (e.g., automatically transmitted) to the solenoid component to transition (e.g., automatically transition or switch) the lock pin from the current position to the desired position. In an aspect, the operation controller component can transmit a transition signal or command to the solenoid component to indicate to or instruct the solenoid component to transition the lock pin (and associated solenoid plunger) from the current position to the desired position in relation to the lock receptacle. The solenoid component, and transition component therein, can receive the transition signal or command.

At 916, the lock pin can be transitioned from the current position to the desired position, in response to the application of the desired amount of power. In response to the received transition signal or command, the transition component can transition the lock pin from the current position to the desired position, wherein the transition component can used the power received from the power supply to facilitate generating and applying a desired amount of force (e.g., electromagnetic force) to the solenoid plunger, and thereby applying a desired amount of force to the lock pin, to cause the solenoid plunger to overcome the force (e.g., magnetic force) applied to the solenoid plunger by the holder component associated with the current position and move the solenoid plunger and the associated lock pin in the desired direction to the desired position.

At 918, the power can be discontinued or no longer used. After the transition of the lock pin to the desired position has occurred, power can be discontinued or at least no longer used by the solenoid component in relation to the lock pin. At 920, the lock pin can be held in the desired position (e.g., second or locked position) associated with the power off condition, without consuming power in order to maintain the lock pin in the desired position. In an aspect, the solenoid component can include a holder component, which is associated with the desired position, that can apply a desired amount of force (e.g., magnetic force) to the solenoid plunger, and thereby to the lock pin, wherein the force is of sufficient magnitude to hold the solenoid plunger and the associated lock pin in the desired position without consuming power in order to do so.

Figure 10:
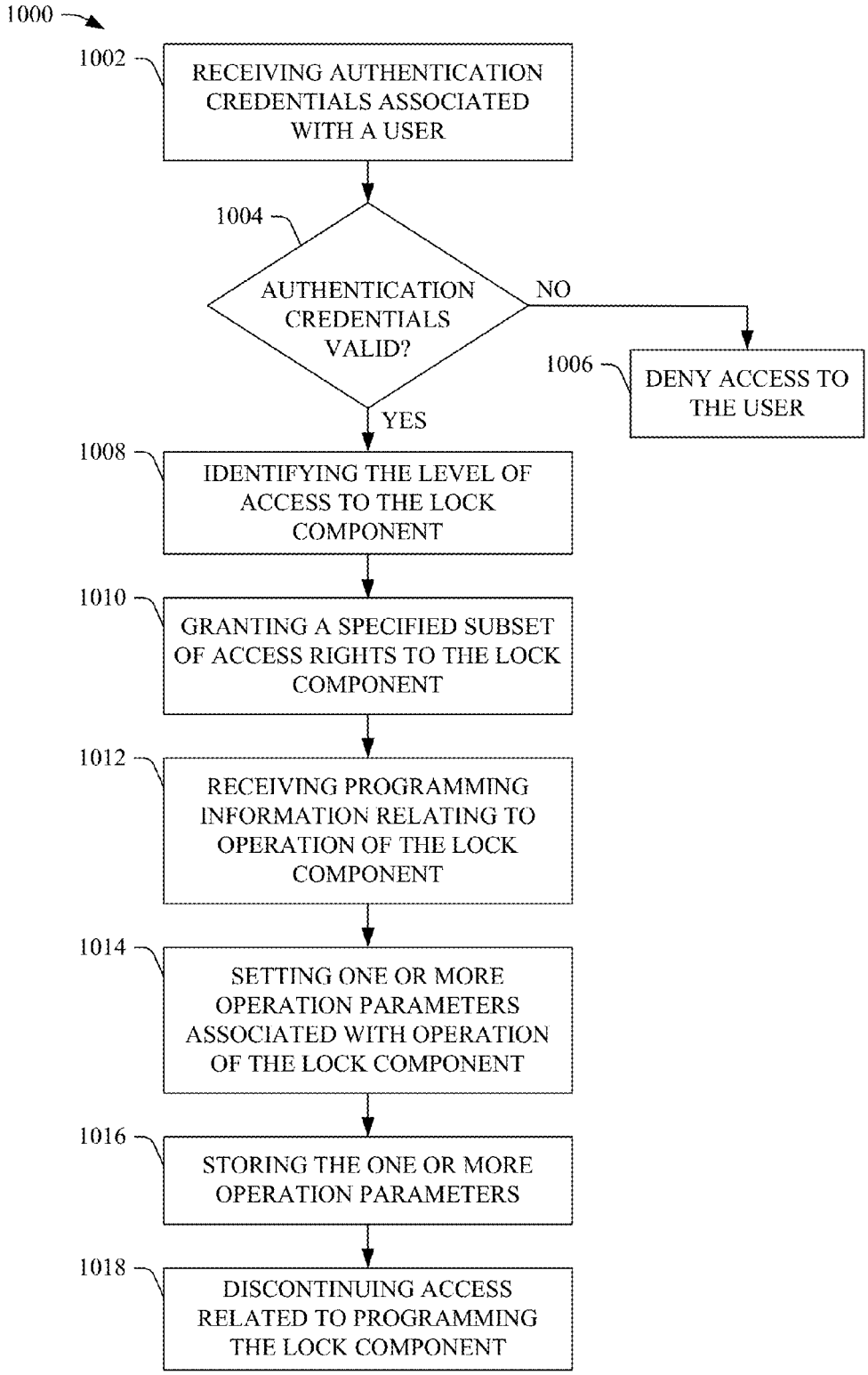
FIG. 10 depicts a flowchart of an example methodology-can facilitate programming a lock component in accordance with an aspect of the disclosed subject matter.

Referring to FIG. 10, illustrated is an example methodology 1000 that can facilitate programming a lock component in accordance with an aspect of the disclosed subject matter. At 1002, authentication credentials associated with a user can be received. For instance, authentication credentials can be requested from a user in relation to programming of the lock component or for other desired reasons. The authentication credentials can be in the form of a password, passcode, PIN, biometric information, etc., and can be received from the user via a suitable interface (e.g., keypad, keyboard, touch screen, biometric scanner or pad, etc).

At 1004, a determination can be made regarding whether the authentication credentials are valid. In an aspect, the operation controller component and/or authentication component can compare the received authentication credentials to approved authentication credentials, which can be retrieved from a data store, to determine whether the received authentication credentials match any of the approved authentication credentials.

If it is determined that the authentication credentials are not valid, at 1006, access to the lock component can be denied. If the authentication credentials are not valid, the operation controller component can deny access to the lock component and the user will be unable to program the lock component.

If, at 1004, it is determined that the authentication credentials are valid, at 1008, the level of access to the lock component can be determined or identified. If the authentication credentials are determined to be valid (e.g., authentication credentials match approved authentication credentials), the operation controller component and/or authentication component can determine or identify a level of access to the lock component that can be granted to the user.

At 1010, a specified subset of access rights to the lock component can be granted based at least in part on the received authentication credentials and predefined access criteria. In an aspect, there can be one or more different levels of access rights that can be granted to users, wherein the level of access granted can be based at least in part on the authentication credentials and predefined access criteria.

At 1012, programming information relating to operation of the lock component can be received. In an aspect, programming information can be received from the user via a suitable interface, wherein the programming information can relate . to operation of the lock component under various conditions. The programming information can comprise operation parameters (e.g., POWER CONDITION parameter="impending power off condition detected" results in OPERATION parameter="placing the lock pin in a (desired) position" (e.g., locked position)) or other information, for example.

At 1014, one or more operation parameters associated with operation of the lock component can be set based at least in part on the received programming information and other predefined operation criteria. In an aspect, the operation controller component and/or program component can facilitate setting one or more operation parameters associated with operation of the lock component based at least in part on the received programming information and in accordance with the predefined operation criteria.

At 1016, the one or more operation parameters can be stored. In an aspect, the operation controller component and/or program component can facilitate storing the one or more operation parameters and/or other information relating to the programming of the lock component in a data store.

At 1018, access related to programming the lock component can be discontinued. In an aspect, the operation controller component and/or authentication component can close or discontinue access to the lock component, for example, when the programming of the lock component is completed or for other desired reasons (e.g., a predefined amount of time has elapsed since access was granted to the user or a predefined amount of time has elapsed since interaction with the lock component by the user, etc.).

It is to be appreciated and understood that, in accordance with other embodiments, in addition to or alternative to the operation controller component performing certain acts associated with methodology 1000, as described herein, a computer or other device or system remote from the lock component, but connected to the lock component, can perform desired acts (e.g., authenticating a user; receiving program information; setting operation parameters; etc.) to facilitate programming the lock component or other desired acts associated with the lock component.

For purposes of simplicity of explanation, methodologies that can be implemented in accordance with the disclosed subject matter were shown and described as a series of blocks. However, it is to be understood and appreciated that the disclosed subject matter is not limited by the order of the blocks, as some blocks can occur in different orders and/or concurrently with other blocks from what is depicted and described herein. Moreover, not all illustrated blocks can be required to implement the methodologies described hereinafter. Additionally, it should be further appreciated that the methodologies, or at least portions thereof, disclosed throughout this specification are capable of being stored on an article of manufacture to facilitate transporting and transferring such methodologies to computers. The term article of manufacture, as used, can encompass a computer program accessible from any computer-readable device, carrier, or media.

Figure 11:
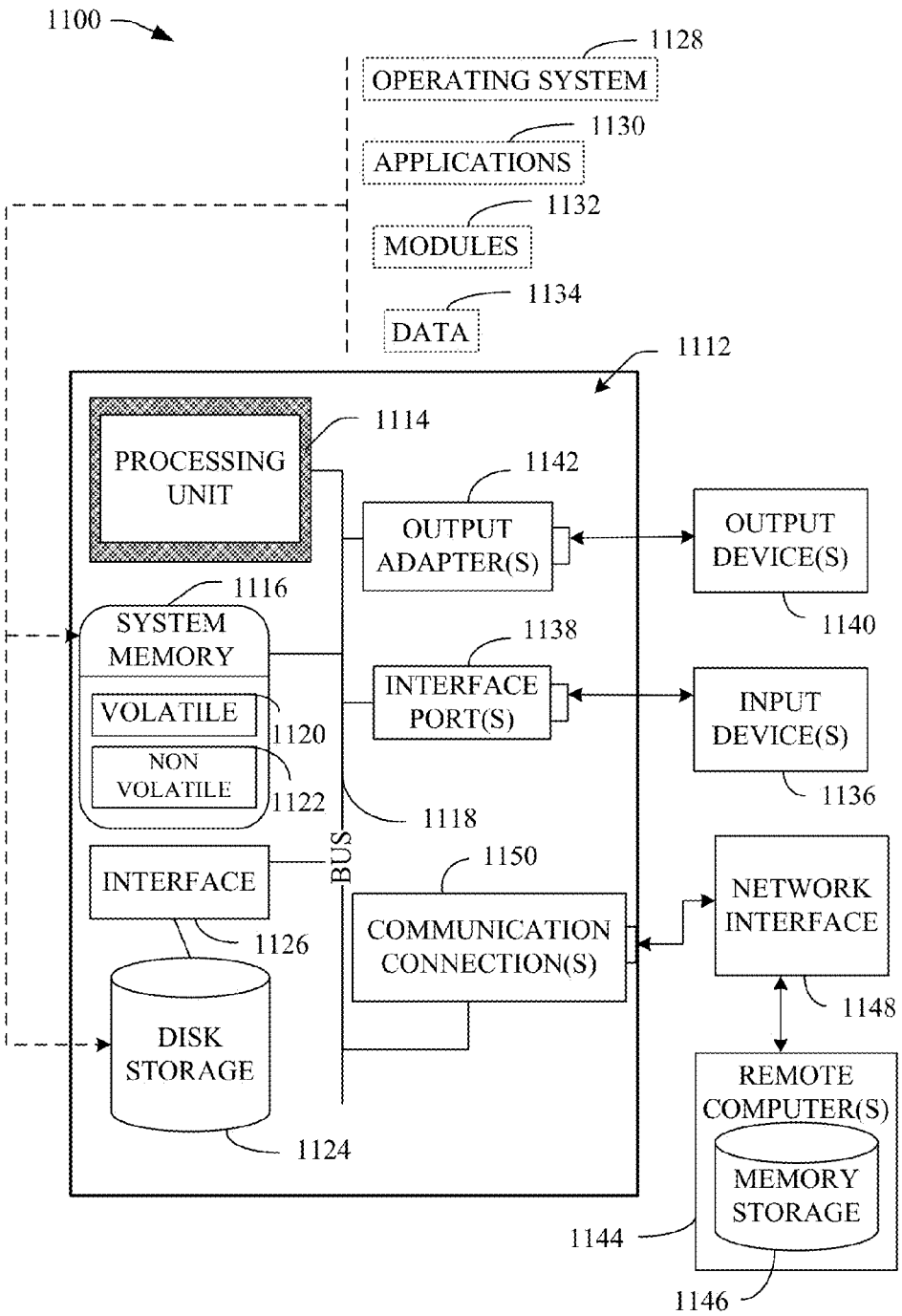
FIG. 11 is a schematic block diagram illustrating a suitable operating environment.
Figure 12:
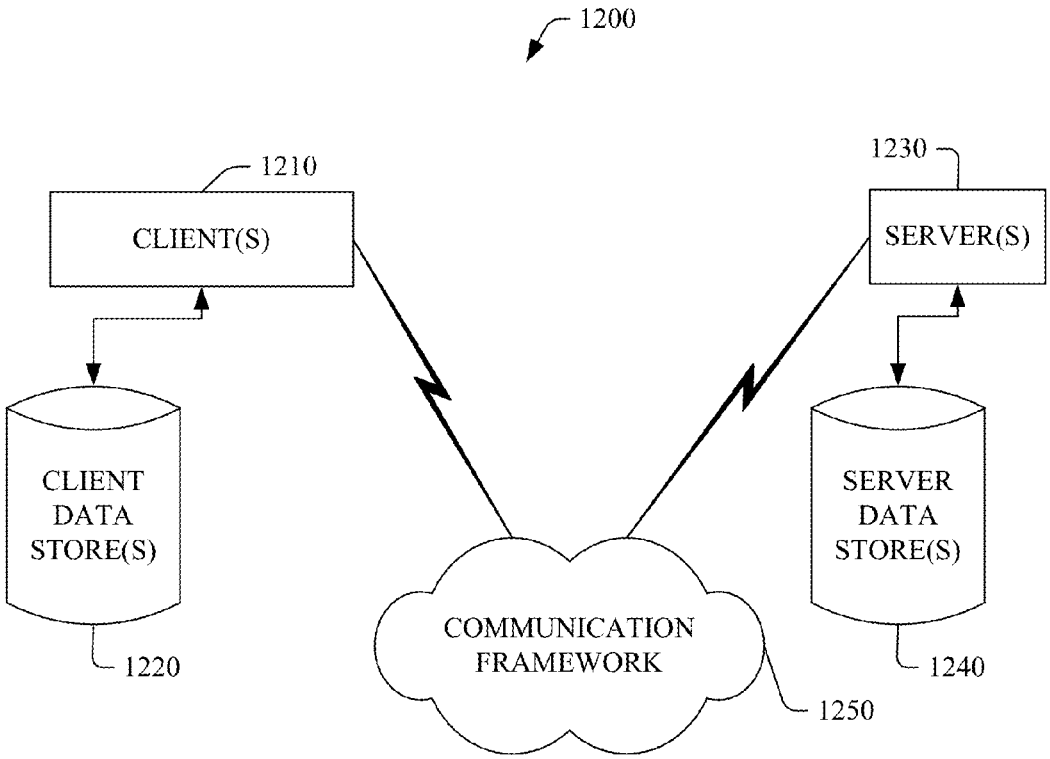
FIG. 12 is a schematic block diagram of a sample-computing environment.

In order to provide a context for the various aspects of the disclosed subject matter, FIGS. 11 and 12 as well as the following discussion are intended to provide a brief, general description of a suitable environment in which the various aspects of the disclosed subject matter can or may be implemented. While the subject matter has been described above in the general context of computer-executable instructions of a computer program that runs on a computer and/or computers, those skilled in the art will recognize that the subject innovation also may be implemented in combination with other program modules. Generally, program modules include routines, programs, components, data structures, etc. that perform particular tasks and/or implement particular abstract data types. Moreover, those skilled in the art will appreciate that the inventive methods may be practiced with other computer system configurations, including single-processor or multiprocessor computer systems, mini-computing devices, mainframe computers, as well as personal computers, hand-held computing devices (e.g., personal digital assistant (PDA), phone, watch), microprocessor-based or programmable consumer or industrial electronics, and the like. The illustrated aspects may also be practiced in distributed computing environments where tasks are performed by remote processing devices that are linked through a communications network. However, some, if not all aspects of the claimed innovation can be practiced on stand-alone computers. In a distributed computing environment, program modules may be located in both local and remote memory storage devices.

With reference to FIG. 11, a suitable environment 1100 for implementing various aspects of the claimed subject matter includes a computer 1112. The computer 1112 includes a processing unit 1114, a system memory 1116, and a system bus 1118. The system bus 1118 couples system components including, but not limited to, the system memory 1116 to the processing unit 1114. The processing unit 1114 can be any of various available processors. Dual microprocessors and other multiprocessor architectures also can be employed as the processing unit 1114.

The system bus 1118 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 1116 includes volatile memory 1120 and nonvolatile memory 1122. The basic input/output system (BIOS), containing the basic routines to transfer information between elements within the computer 1112, such as during start-up, is stored in nonvolatile memory 1122. By way of illustration, and not limitation, nonvolatile memory 1122 can include read only memory (ROM), programmable ROM (PROM), electrically programmable ROM (EPROM), electrically erasable programmable ROM (EEPROM), or flash memory. Volatile memory 1120 includes random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and Rambus dynamic RAM (RDRAM).

Computer 1112 also includes removable/non-removable, volatile/non-volatile computer storage media. FIG. 11 illustrates, for example, a disk storage 1124. Disk storage 1124 includes, but is not limited to, devices like a magnetic disk drive, floppy disk drive, tape drive, Jaz drive, Zip drive, LS-100 drive, flash memory card, or memory stick. In addition, disk storage 1124 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1124 to the system bus 1118, a removable or non-removable interface is typically used, such as interface 1126.

It is to be appreciated that FIG. 11 describes software that acts as an intermediary between users and the basic computer resources described in the suitable operating environment 1100. Such software includes an operating system 1128. Operating system 1128, which can be stored on disk storage 1124, acts to control and allocate resources of the computer system 1112. System applications 1130 take advantage of the management of resources by operating system 1128 through program modules 1132 and program data 1134 stored either in system memory 1116 or on disk storage 1124. It is to be appreciated that the claimed subject matter can be implemented with various operating systems or combinations of operating systems.

A user enters commands or information into the computer 1112 through input device(s) 1136. Input devices 1136 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1114 through the system bus 1118 via interface port(s) 1138. Interface port(s) 1138 include, for example, a serial port, a parallel port, a game port, and a universal serial bus (USB). Output device(s) 1140 use some of the same type of ports as input device(s) 1136. Thus, for example, a USB port may be used to provide input to computer 1112, and to output information from computer 1112 to an output device 1140. Output adapter 1142 is provided to illustrate that there are some output devices 1140 like monitors, speakers, and printers, among other output devices 1140, which require special adapters. The output adapters 1142 include, by way of illustration and not limitation, video and sound cards that provide a means of connection between the output device 1140 and the system bus 1118. It should be noted that other devices and/or systems of devices provide both input and output capabilities such as remote computer(s) 1144.

Computer 1112 can operate in a networked environment using logical connections to one or more remote computers, such as remote computer(s) 1144. The remote computer(s) 1144 can be a personal computer, a server, a router, a network PC, a workstation, a microprocessor based appliance, a peer device or other common network node and the like, and typically includes many or all of the elements described relative to computer 1112. For purposes of brevity, only a memory storage device 1146 is illustrated with remote computer(s) 1144. Remote computer(s) 1144 is logically connected to computer 1112 through a network interface 1148 and then physically connected via communication connection 1150. Network interface 1148 encompasses wire and/or wireless communication networks such as local-area networks (LAN) and wide-area networks (WAN). LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1150 refers to the hardware/software employed to connect the network interface 1148 to the bus 1118. While communication connection 1150 is shown for illustrative clarity inside computer 1112, it can also be external to computer 1112. The hardware/software necessary for connection to the network interface 1148 includes, for exemplary purposes only, internal and external technologies such as, modems including regular telephone grade modems, cable modems and DSL modems, ISDN adapters, and Ethernet cards.

FIG. 12 is a schematic block diagram of a sample-computing environment 1200 with which the subject innovation can interact. The system 1200 includes one or more client(s) 1210. The client(s) 1210 can be hardware and/or software (e.g., threads, processes, computing devices). The system 1200 also includes one or more server(s) 1230. Thus, system 1200 can correspond to a two-tier client server model or a multi-tier model (e.g., client, middle tier server, data server), amongst other models. The server(s) 1230 can also be hardware and/or software (e.g., threads, processes, computing devices). The servers 1230 can house threads to perform transformations by employing the subject innovation, for example. One possible communication between a client 1210 and a server 1230 may be in the form of a data packet transmitted between two or more computer processes.

The system 1200 includes a communication framework 1250 that can be employed to facilitate communications between the client(s) 1210 and the server(s) 1230. The client(s) 1210 are operatively connected, to one or more client data store(s) 1220 that can be employed to store information local to the client(s) 1210. Similarly, the server(s) 1230 are operatively connected to one or more server data store(s) 1240 that can be employed to store information local to the servers 1230.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

A computer typically includes a variety of computer-readable media. Computer-readable media can be any available media that can be accessed by the computer and includes both volatile and nonvolatile media, removable and non-removable media. By way of example, and not limitation, computer-readable media can comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embody computer-readable instructions, data structures, program modules or other data in a modulated data signal such as a carrier wave or other transport mechanism, and includes any information delivery media. By way of example, and not limitation, communication media include wired media such as a wired network or direct-wired connection, and wireless media such as acoustic, RF, infrared and other wireless media. Combinations of the any of the above should also be included within the scope of computer-readable media.

The aforementioned systems have been described with respect to interaction among several components. It should be appreciated that such systems and components can include those components or sub-components specified therein, some of the specified components or sub-components, and/or additional components. Sub-components can also be implemented as components communicatively coupled to other components rather than included within parent components. Additionally, it should be noted that one or more components could be combined into a single component providing aggregate functionality. The components could also interact with one or more other components not specifically described herein but known by those of skill in the art.

Furthermore, the disclosed subject matter can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications can be made to this configuration without departing from the scope or spirit of the disclosed subject matter.

Some portions of the detailed description have been presented in terms of algorithms and/or symbolic representations of operations on data bits within a computer memory. These algorithmic descriptions and/or representations are the means employed by those cognizant in the art to most effectively convey the substance of their work to others equally skilled. An algorithm is here, generally, conceived to be a self-consistent sequence of acts leading to a desired result. The acts are those requiring physical manipulations of physical quantities. Typically, though not necessarily, these quantities take the form of electrical and/or magnetic signals capable of being stored, transferred, combined, compared, and/or otherwise manipulated.

It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities. Unless specifically stated otherwise as apparent from the foregoing discussion, it is appreciated that throughout the disclosed subject matter, discussions utilizing terms such as processing, computing, calculating, determining, and/or displaying, and the like, refer to the action and processes of computer systems, and/or similar consumer and/or industrial electronic devices and/or machines, that manipulate and/or transform data represented as physical (electrical and/or electronic) quantities within the computer's and/or machine's registers and memories into other data similarly represented as physical quantities within the machine and/or computer system memories or registers or other such information storage, transmission and/or display devices.

In the subject specification, terms such as "data store," "storage," and substantially any other information storage component relevant to operation and functionality of a component, refer to "memory components," or entities embodied in a "memory" or components comprising the memory. For example, information relevant to operation of various components described in the disclosed subject matter, and that can be stored in a memory, can comprise, but is not limited to comprising, information relating to operation of the lock component, programming information, information relating to authentication and authorization to access the lock component, etc. It will be appreciated that the memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), phase change memory (PCM), flash memory, or nonvolatile RAM (e.g., ferroelectric RAM (FeRAM). Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

Further, as used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What has been described above includes examples of the subject specification. It is, of course, not possible to describe every conceivable combination of components or methodologies for purposes of describing the subject specification, but one of ordinary skill in the art can recognize that many further combinations and permutations of the subject specification are possible. Accordingly, the subject specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system, comprising:

a lock pin that is configured to be movable between at least a first position and a second position to facilitate placement of a lock component in an unlocked state or a locked state based at least in part on whether the lock pin is in the first position or the second position;

a solenoid component that is configured to, at a first period of time, apply a first force to a solenoid plunger, associated with the lock pin, and thereby to the lock pin, to hold the lock pin in the first position and, at a second period of time, apply a second force to the solenoid plunger, and thereby to the lock pin, to hold the lock pin in the second position without consuming electrical power to hold the lock pin in the first position or the second position, based at least in part on a defined operation criterion; and an operation controller component that is configured to, in response to receipt of a signal that indicates a power off condition associated with the lock component is to occur within a defined period of time, transmit a lock signal to the solenoid component to direct the solenoid component to facilitate placing or transitioning the lock pin in or to the second position to facilitate placement of the lock component in the locked state.

2. The system of claim 1, further comprising:

a sensor component that is configured to monitor power conditions associated with the lock component and sense that the power off condition associated with the lock component is to occur within the defined period of time, wherein, in response to the lock pin being in the first position, the solenoid component is further configured to generate and apply a transition force to the solenoid plunger, and thereby to the lock pin, to transition the lock pin from the first position to the second position in response to the power off condition being sensed to facilitate placement of the lock component in the locked state.

3. The system of claim 2, wherein at least a portion of the solenoid plunger is constructed of a ferromagnetic metal material, and wherein the solenoid component further comprising:

a first holder component that comprises a first permanent magnet configured to apply the first force to the solenoid plunger, wherein the first force is a magnetic force of a first magnitude; and a second holder component that comprises a second permanent magnet configured to apply the second force to the solenoid plunger, wherein the second force is a magnetic force of a second magnitude.

4. The system of claim 2, wherein the solenoid component further comprising:

a transition component that is configured to apply the transition force to the solenoid plunger, based at least in part on the defined operation criterion, wherein the transition force is an electromagnetic force that has a magnitude sufficient to, at respective times, overcome the first force and move the solenoid plunger and the lock pin associated with the solenoid plunger from the first position to the second position, or overcome the second force and move the solenoid plunger and the lock pin from the second position to the first position.

5. The system of claim 1, wherein the lock pin is configured to not engage a lock receptacle in response to the lock pin being in the first position to place the lock pin in the unlocked state, and to engage the lock receptacle in response to the lock pin being in the second position to place the lock pin in the locked state.

6. The system of claim 1, wherein the operation controller component is configured to control a set of operations of the lock component, wherein the set of operations comprises a transition operation that facilitates transitioning the lock pin between the first position and the second position based at least in part on a power-condition status associated with the lock component, and a power operation that facilitates transitioning between a primary power source and a secondary power source associated with the lock component based at least in part on a status of the primary power source.

7. The system of claim 1, further comprising:

a program component that is configured to program a set of operations of the lock component, wherein the set of operations comprises identification of the second position as a position the lock pin is to be placed in response to the power off condition associated with the lock component being sensed, and placement or transition of the lock pin to the second position, wherein the second position is associated with the locked state; and an authentication component that is configured to determine whether a user is authorized to access the program component and to determine access rights that can be granted to an authorized user based at least in part on an authentication credential received from the user and a stored valid authentication credential.

8. The system of claim 1, further comprising:

a primary power source that is configured to provide power to the lock component to facilitate performance of at least a set of operations of the lock component by the lock component; and a secondary power source that is configured to provide power to the lock component at least in response to the primary power source being in the power off condition to facilitate performance of one or more operations of the set of the operations by the lock component.

9. A method, comprising:

at a first period of time, holding a lock pin associated with a lock in a first position without utilizing electrical power to facilitate maintaining a door associated with the lock in a position corresponding to the first position;

at a second period of time, holding the lock pin in a second position without utilizing electrical power, after the lock pin is transitioned to the second position, to facilitate maintaining the door in a position corresponding to the second position, based at least in part on a defined operation criterion;

receiving a power off indicator that indicates detection of a power off condition associated with the lock impending within a defined period of time; and transmitting a transition signal to facilitate transitioning the lock pin from the first position to the second position in response to the power off indicator being received and the lock pin being in the first position.

10. The method of claim 9, wherein the first position is an unlocked position, wherein the lock pin is not engaging the hole in a lock receptacle associated with a door frame that is associated with the door; and the second position is a locked position, wherein the lock pin is engaging the hole in the lock receptacle to lock the door.

11. The method of claim 9, further comprising:

monitoring power conditions associated with the lock;

detecting the power off condition associated with the lock is impending within the defined period of time; and transmitting the power off indicator relating to the power off condition in response to the power off condition being detected.

12. The method of claim 9, further comprising:

applying a specified amount of power to facilitate switching the lock pin to the second position from the first position in response to the power off condition being detected;

switching the lock pin from the first position to the second position in response to the applying of the specified amount of power to facilitate placing the lock pin in a locked state in relation to a lock receptacle.

13. The method of claim 12, further comprising:

controlling at least one operation associated with the lock, wherein the controlling of the at least one operation comprises: facilitating transitioning between a primary power supply and an auxiliary power supply associated with the lock based at least in part on a status of the primary power supply.

14. The method of claim 9, further comprising:

receiving an authentication credential associated with a user;

comparing the authentication credential with at least one approved authentication credential;

at least one of:

denying access related to programming of the lock component in response to the authentication credential not matching any approved authentication credential, or granting a set of access rights related to programming of the lock component in response to the authentication credential matching the at least one approved authentication credential.

15. The method of claim 14, further comprising:

receiving programming information related to programming of at least one operation associated with the lock in response to the set of access rights being granted; and programming the lock to perform the at least one operation in accordance with the programming information, wherein a portion of the programming information relates to the defined operation criterion.

16. The method of claim 9, further comprising:

detecting the power off condition associated with the lock and a primary power supply associated with the lock; and switching from the primary power supply to an auxiliary power supply in response to the detecting of the power off condition associated with the lock and the primary power supply.

17. A system, comprising:

means for holding a lock pin associated with a lock component in an unlocked position at a first specified instance by applying a first force to a solenoid plunger of a solenoid component, associated with the lock pin, and thereby to the lock pin without consuming electrical power to hold the lock pin in the unlocked position;

means for holding the lock pin in a locked position at a second specified instance by applying a second force to the solenoid plunger and thereby to the lock pin without consuming electrical power to hold the lock pin in the locked position, in response to the lock pin being transitioned to the locked position, in accordance with a defined operation criterion; and means for sensing a power off condition is to occur within a defined period of time means for controlling at least one operation associated with the lock component comprising means for transitioning the lock pin from the unlocked position to the locked position, in response to the sensing of the power off condition in accordance with the defined operation criterion.

18. The system of claim 17, further comprising:

means for transitioning between a primary power source and a secondary power source associated with the lock component based at least in part on a status of the primary power source.

* * * * *